US006692327B1

(12) United States Patent
Deguchi et al.

(10) Patent No.: US 6,692,327 B1
(45) Date of Patent: Feb. 17, 2004

(54) METHOD FOR PRODUCING ELECTRON EMITTING ELEMENT

(75) Inventors: Masahiro Deguchi, Osaka (JP); Makoto Kitabatake, Nara (JP); Kanji Imai, Osaka (JP); Tomohiro Sekiguchi, Hyogo (JP); Hideo Kurokawa, Osaka (JP); Keisuke Koga, Kyoto (JP); Tetsuya Shiratori, Osaka (JP); Toru Kawase, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/480,415

(22) Filed: Jan. 11, 2000

(30) Foreign Application Priority Data

Jan. 13, 1999 (JP) ..... 11-007061

(51) Int. Cl.[7] ..... H01J 9/02

(52) U.S. Cl. ..... 445/49; 445/50; 445/51; 313/309; 313/310; 313/495

(58) Field of Search ..... 313/310, 309, 313/495; 445/50, 51, 24, 49

(56) References Cited

U.S. PATENT DOCUMENTS

| | | | | |
|---|---|---|---|---|
| 5,155,420 A | * | 10/1992 | Smith | 313/309 |
| 5,709,577 A | | 1/1998 | Jin et al. | |
| 5,726,524 A | * | 3/1998 | Debe | 204/192.1 |
| 5,796,211 A | | 8/1998 | Graebner et al. | |
| 5,821,679 A | | 10/1998 | Makishima | |
| 5,967,873 A | * | 10/1999 | Rabinowitz | 204/192.11 |
| 5,977,697 A | | 11/1999 | Jin et al. | |
| 6,057,637 A | * | 5/2000 | Zettl et al. | 313/310 |
| 6,087,765 A | * | 7/2000 | Coll et al. | 313/309 |
| 6,097,138 A | * | 8/2000 | Nakaqmoto | 313/309 |
| 6,232,706 B1 | * | 5/2001 | Dai et al. | 313/309 |
| 6,239,547 B1 | * | 5/2001 | Uemura et al. | 313/309 |
| 6,250,984 B1 | * | 6/2001 | Jin et al. | 313/306 |
| 6,299,812 B1 | * | 10/2001 | Newman et al. | 264/176.1 |

FOREIGN PATENT DOCUMENTS

| | | | |
|---|---|---|---|
| EP | 520 780 | 12/1992 | |
| EP | 660 368 | 6/1995 | |
| EP | 0 905 737 A1 | 3/1999 | |
| JP | 10-92294 | 4/1998 | |
| JP | 11-111158 | 4/1999 | |
| JP | 2001076651 A * | 3/2001 | H01J/31/12 |
| WO | WO 94/15352 | 7/1994 | |

OTHER PUBLICATIONS

"Fabrication of Silicon Field Emitter Arrays Integrated with Beam Focusing Lens" (Yoshikazu Yamaoka et al., Dec. 1996).

"Fabrication of encapsulated silicon–vacuum field–emission transistors and diodes" (C.T. Sune et al., Dec. 1992).

"Electron Field Emitters Based on Carbon Nanotube Films" (Walt A. De Heer et al., Jan. 1997).

* cited by examiner

*Primary Examiner*—Nimeshkumar D. Patel
*Assistant Examiner*—Sikha Roy
(74) *Attorney, Agent, or Firm*—Merchant & Gould P.C.

(57) ABSTRACT

An electron emission element includes a substrate, a cathode electrode formed on the substrate, an anode electrode disposed so as to be opposed to the cathode electrode, an electron emission member disposed on the cathode electrode, a control electrode disposed between the cathode electrode and the anode electrode, and an insulating layer. The electron emission member includes a first member having a hole and a second member filling the hole, wherein the second member is more likely to emit electrons than the first member.

5 Claims, 19 Drawing Sheets

METHOD FOR PRODUCING ELECTRON EMITTING ELEMENT

BACKGROUND OF THE INVENTION

1. Field of the Invention

The present invention relates to an electron emission element, a method for producing the same, and a light-emitting device using the same.

2. Description of the Related Art

In recent years, as an electron beam source for a flat display, an emitter portion of a vacuum device that can be operated at high speed and the like, a cold cathode electron source has been considered, which replaces a hot cathode electron source requiring heating. There are various types of cold cathode electron sources. In particular, a field emission (FE)-type, a tunnel injection (MIM, MIS)-type, and a surface conduction (SC)-type are known.

In a FE-type electron source, an electric field is applied to a cone-shaped projection (electron emission portion) made of silicon (Si), molybdenum (Mo), or the like, whereby electrons are emitted from the end of the projection. In MIM-type and MIS-type electron sources, a layered structure (e.g., metal/insulator/metal (or semiconductor)) is formed, and electrons are injected through the metal side, whereby the injected electrons are taken out of an electron emission portion. Furthermore, in an SC-type electron source, an electric current is allowed, to flow in an in-plane direction of a thin film formed on a substrate, whereby conductive electrons are partially taken out of a previously formed crack portion in the thin film.

The above-mentioned elements have features in that they can be minimized and integrated by using fine processing technology. These elements also have features in that heating is not required, unlike a hot cathode electron source.

FIG. 14 shows an example of a conventional electron emission element using a FE-type electron source. Referring to FIG. 14, a conventional electron emission element 1 includes a substrate 2, a cathode electrode 3 formed on the substrate 2, a cone-shaped electron emission member 4 disposed on the cathode electrode 3, an anode electrode 5 disposed so as to be opposed to the cathode electrode 3, a control electrode 6 disposed between the cathode electrode 3 and the anode electrode 5, and an insulating layer 7 supporting the control electrode 6.

In general, the following characteristics are desired for an electron emission material and an electron emission element using the same. (1) Electrons can be emitted at a low electric power (i.e., a material has a high electron emission ability). (2) Stable electron emission characteristics can be maintained (i.e., an emitter portion is chemically/physically stable). (3) Outstanding wear resistance and heat resistance can be obtained.

However, in the conventional electron emission element 1, an emission amount of electrons greatly depends upon the shape of the electron emission member 4, and it is very difficult to produce and control the electron emission member 4. Furthermore, Si, Mo, and the like generally used as a material for the electron emission member 4; do not have sufficient surface stability.

Therefore, conventionally, an electron emission material for use in an electron emission member has been studied. In particular, carbon materials have been considered as those which are capable of emitting electrons even at a low electric field. For example, it is reported that carbon fiber functions as a field emitter irrespective of its relatively high work function. Furthermore, it is reported that a carbon nanotube has a six-membered net of carbon wound in a cylindrical shape, and electrons are likely to be emitted from an end facet thereof However, carbon materials such as a carbon nanotube are difficult to handle as an electron emission material due to their powdery shape and brittleness. It is also difficult to dispose carbon nanotubes in such a manner as to control the direction of the end facets thereof, which are likely to emit electrons.

As described above, the electron emission elements and electron emission materials that have been used do not sufficiently satisfy the required characteristics and are difficult to handle.

SUMMARY OF THE INVENTION

Therefore, with the foregoing in mind, it is an object of the present invention to provide an electron emission element having a high electron emission ability, a method for producing the same; and a light-emitting device using the same.

In order to achieve the above-mentioned objective, an electron emission element of the present invention includes: a cathode electrode; an anode electrode disposed so as to be opposed to the cathode electrode; and an electron emission member disposed on the cathode electrode, wherein the electron emission member includes a first member having a hole and a second member filling the hole, and the second member is more likely to emit electrons than the first member. In this electron emission element, a material that has a high electron emission ability but is difficult to handle can be used as a material for the second member. Therefore, an electron emission element with a high electron emission ability can be obtained.

It is preferable that the above-mentioned electron emission element further includes a control electrode between the anode electrode and the cathode electrode, for controlling electron emission from the electron emission member. According to this structure, an electron emission amount from the electron emission member can be controlled easily by changing an electric potential of the control electrode.

In the above-mentioned electron emission element, it is preferable that the first member includes an insulating layer on an outer periphery, and the control electrode is formed on the insulating layer. According to this structure, the control electrode can be disposed with good precision, so that electron emission from the second member can easily be controlled.

In the above-mentioned electron emission element, the hole is preferably a through-hole. According to this structure, the first member can be filled easily with the second member, so that an electron emission element that can be produced easily, is obtained.

In the above-mentioned electron emission element, it is preferable that the electron emission member includes a convex portion formed of the second member on its end portion on the anode electrode side. According to this structure, an electric field can be concentrated on the convex portion of the second member, so that an electron emission element with a particularly high electron emission ability can be obtained.

In the above-mentioned electron emission element, it is preferable that the second member contains an allotrope of carbon (C). Due to this structure, an electron emission element with a particularly high electron emission ability can be obtained.

In the above-mentioned electron emission element, it is preferable that the second member contains an allotrope of carbon having a graphene structure. Furthermore, it is particularly preferable that the allotrope is a carbon nanotube. Furthermore, it is particularly preferable that a content of the carbon nanotube in the second member is 1% by volume or more. With this structure, an electron emission element with a particularly high electron emission ability is obtained.

In the above-mentioned electron emission element, it is preferable that the second member further includes at least one selected from the group consisting of graphite, fullerene, diamond and diamond-like carbon. With this structure, a highly stable electron emission element is obtained.

In the above-mentioned electron emission element, it is preferable that the first member is made of metal. According to this structure, since metal is easily processed, an electron emission element that can be easily produced is obtained. In particular, it is preferable in terms of safety that the first member contains at least one metal which does not react with carbon, selected from the group consisting of Au, Ag, Cu, Pt, and Al.

In the above-mentioned electron emission element, it is preferable that the first member has a cylindrical shape, and the second member has a columnar shape. According to this structure, an electron emission element that can be easily produced is obtained.

According to the present invention, there is provided a method for producing an electron emission element including a cathode electrode, an anode electrode disposed so as to be opposed to the cathode electrode, and an electron emission member disposed on the cathode electrode. The method includes: filling a substantially cylindrical body made of a first material with a second material different from the first material, followed by drawing and cutting, thereby forming an electron emission member including a first member with a through-hole and a second member that fills the through-hole and is more likely to emit electrons than the first member. According this production method, an electron emission element having a high electron emission ability can be easily produced.

In the above-mentioned production method, it is preferable that the second material contains a carbon nanotube. According to this structure, carbon nanotubes can be arranged substantially in one direction during drawing. Therefore, an electron emission element with a particularly high electron emission ability can be easily produced.

It is preferable that the above-mentioned production method further includes: removing an end portion of the first member to form a convex portion formed of the second member on the electron emission member after forming the electron emission member. According to this structure, an electron emission element with a particularly high electron emission ability can be produced easily.

A light-emitting device of the present invention includes: a substantially vacuum container and a plurality of electron emission elements disposed in the container, wherein the electron emission elements are those of the present invention, and a phosphor film is disposed between the electron emission member and the anode electrode. In this light-emitting device, a light-emitting device with a high light emission intensity is obtained.

It is preferable that the above-mentioned light-emitting device further includes a control electrode between the anode electrode and the cathode electrode, for controlling electron emission from the electron emission member.

In the above-mentioned light-emitting device, it is preferable that the first member includes an insulating layer on an outer periphery, and the control electrode is formed on the insulating layer.

In the above-mentioned light-emitting device, it is preferable that each control electrode of the plurality of electron emission elements is independently controlled. Due to this structure, an image output device with a high light emission intensity is obtained.

In the above-mentioned light-emitting device, it is preferable that the hole is a through-hole.

In the above-mentioned light-emitting device, the electron emission member includes a convex portion formed of the second member on its end portion on the anode electrode side.

In the above-mentioned light-emitting device, it is preferable that the second member contains an allotrope of carbon.

In the above-mentioned light-emitting device, it is preferable that the second member contains an allotrope of carbon with a graphene structure.

In the above-mentioned light-emitting device, the allotrope is a carbon nanotube.

In the above-mentioned light-emitting device, it is preferable that a content of the carbon nanotube in the second member is 1% by volume or more.

In the above-mentioned light-emitting device, it is preferable that the second member further includes at least one selected from the group consisting of graphite, fullerene, diamond and diamond-like carbon.

In the above-mentioned light-emitting device, it is preferable that the first member is made of metal. In particular, it is preferable that the first member contains at least one metal which does not react with carbon, selected from the group consisting of Au, Ag, Cu, Pt, and Al.

In the light-emitting device, it is preferable that the first member has a cylindrical shape, and the second member has a columnar shape.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative embodiments with reference to the drawings.

Embodiment 1

In Embodiment 1, an example of an electron emission element according to the present invention will be described.

Figure 1:
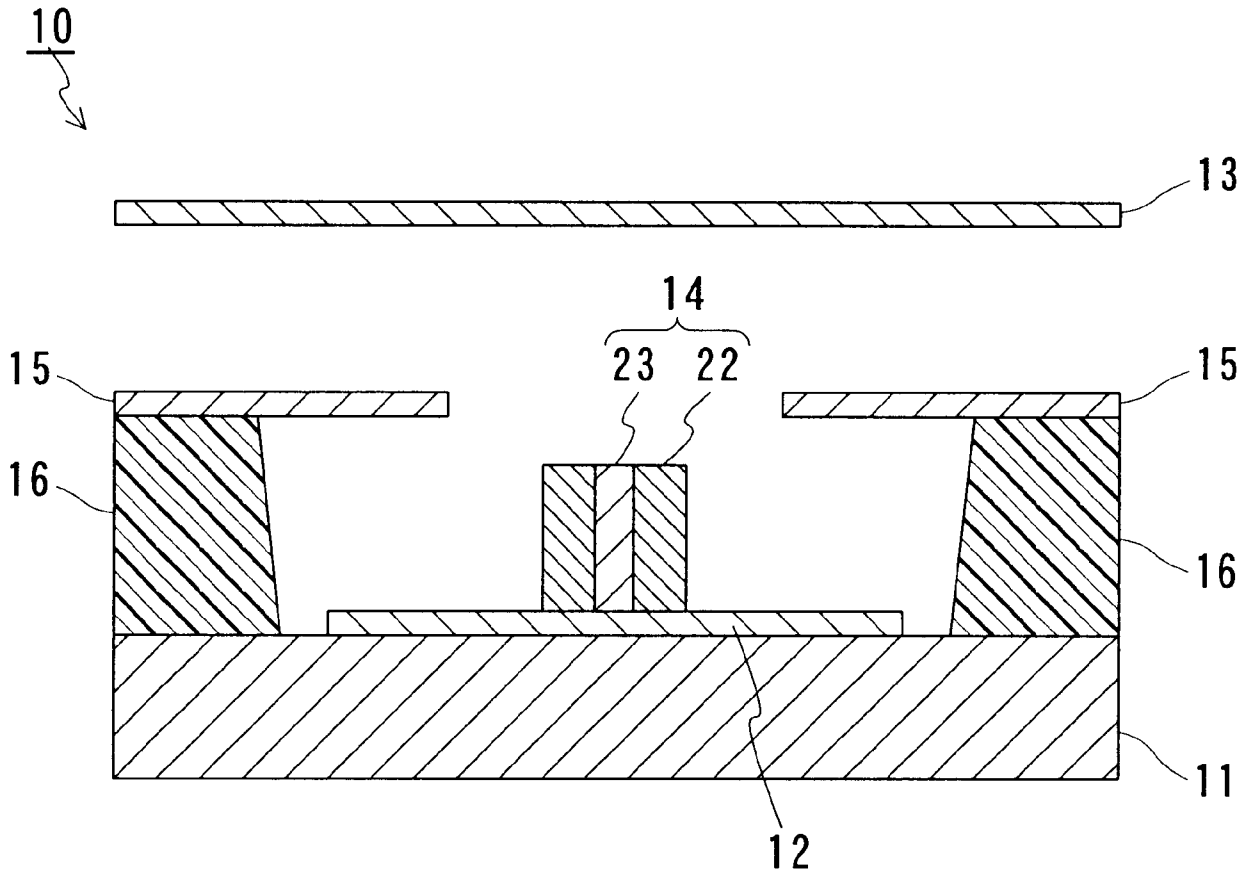
FIG. 1 is a cross-sectional view showing an example of an electron emission element according to the present invention.

FIG. 1 is a cross-sectional view showing an example of an electron emission element 10 in Embodiment 1.

Referring to FIG. 1, the electron emission element 10 includes a cathode electrode 12 formed on a substrate 11, an anode electrode 13 disposed so as to be opposed to the cathode electrode 12, an electron emission member 14 disposed on the cathode electrode 12, a control electrode 15 disposed between the cathode electrode 12 and the anode electrode 13, and an insulating layer 16 supporting the control electrode 15.

The substrate 11 can be made of, for example, glass, quartz, or silicon.

The cathode electrode 12 supplies electrons to the electron emission member 14. The cathode electrode 12 can be made of a low-resistance material such as metal (e.g., Al, Ti, W, etc.) and polycrystalline Si. The cathode electrode 12 also can be made of a layered structure of metal and a low-resistance material, whereby an electric current supplied to the electron emission member 14 can be controlled. In the case where a conductive material is used for the substrate 11, the cathode electrode 12 may be omitted.

The anode electrode 13 may be made of, for example, a metal plate (e.g., Al plate, Mo plate, Cu plate, etc.) or may be made of a metal film formed on a glass substrate. Alternatively, the anode electrode 13 may be made of a transparent conductive film (e.g., ITO, etc.) formed on a glass substrate. The anode electrode 13 forms an electric field for accelerating and collecting emitted electrons.

The electron emission member 14 emits electrons due to an applied electric field. The electrons emitted from the electron emission member 14 are moved to the anode electrode 13 due to an electric field formed by the anode electrode 13 and the control electrode 15.

The control electrode 15 controls emission of electrons from the electron emission member 14. On/off of electron emission and an emission amount of electrons can be controlled by changing the electric potential of the control electrode 15. The control electrode 15 can be made of, for example, metal such as molybdenum (Mo) and aluminum (Al). The control electrode 15 is formed on the insulating layer 16.

The insulating layer 16 fixes the position of the control electrode 15 and electrically insulates the cathode electrode 12 from the control electrode 15. The insulating layer 16 can be made of, for example, silicon dioxide ($SiO_2$) and silicon nitride (SiN).

Hereinafter, the electron emission member 14 will be described in detail.

Figure 2A:
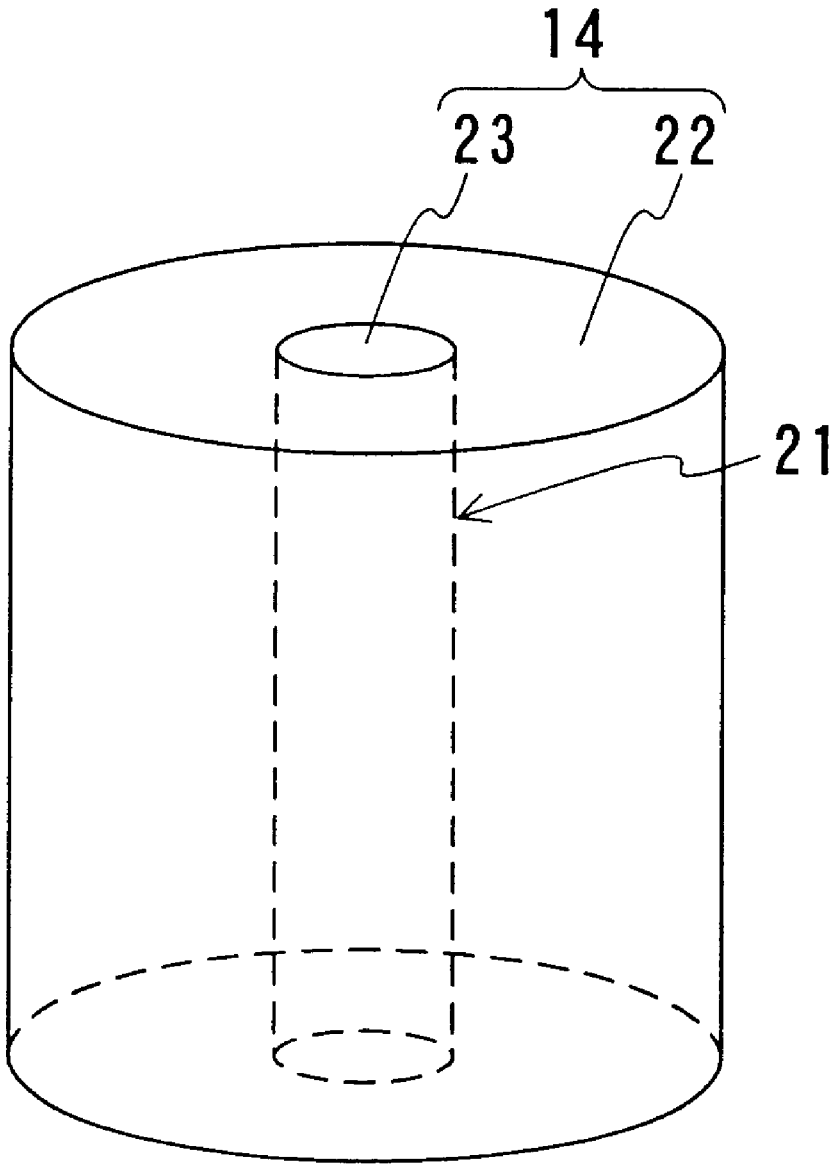
FIGS. 2A through 2D are perspective views each showing an example of an electron emission member of the electron emission element according to the present invention.

FIG. 2A shows an example of the electron emission member 14. Referring to FIG. 2A, the electron emission member 14 includes a first member 22 having a hole 21 and a second member 23 filling the hole 21. In other words, the first member 22 is formed so as to cover the side surface of the second member 23. The second member 23 is more likely to emit electrons than the first member 22. FIG. 2A shows the case where the hole 21 is a through-hole. By forming the hole 21 as a through-hole, the first member 22 easily can be filled with the second member 23. Thus, the electron emission member 14 as shown in FIG. 2A easily can be mass-produced.

The first member 22 can be made of, for example, metal. In particular, in the case where the second member 23 contains a carbon material, the first member 22 is preferably made of a material that does not react with carbon. Specifically, the first member 22 preferably contains at least one selected from the group consisting of gold, silver, copper, platinum, aluminum, and alloys thereof.

The second member 23 can be made of various members that are more likely to emit electrons than the first member. The meaning of "ease of emission of electrons" as used herein will be described. When energy is given to a material by some method, electrons in the vicinity of the material surface can overcome an energy barrier to be emitted in a vacuum. In the case where electrons are taken out of a material by giving energy to the material, there is a work function as a physical index representing electron emission ability of the material. Generally, a material with a smaller work function is more likely to emit electrons. However, electron emission ability of a material is not determined only by a work function for the following reason. In the case where electrons are emitted from a material by applying an electric field to the material, an electron emission amount is. varied depending upon how an electric field is applied to the material. More specifically, an electron emission ability of a material greatly depends upon a shape factor (shape, size, structure, etc.) of the material, and an electron state thereof. Thus, the "ease of emission of electrons" as used herein is determined considering all of these. More specifically, the "ease of emission of electrons" is determined, compared with an electron emission amount under the same condition.

As a material that can be used for the second member 23, although varied depending upon the first member 22, for example, a material containing metal with a low work function, a material containing an oxide with a low work function, a material containing a nitride such as boron nitride (BN), a material containing a carbon compound, a material containing carbon (content of carbon is 1% by volume or more) as its main component, etc. can be used. The second member 23 preferably contains a carbon allotrope. Examples of the carbon allotrope include diamond, graphite, a carbon nanotube. Among them, a carbon allotrope having a graphene structure is particularly preferred. An example of the carbon allotrope having a graphene structure includes a carbon nanotube. In the case where the second member 23 contains carbon nanotubes, the content of carbon nanotubes is preferably 1% by volume or more, in particular 10% by volume or more.

In the case where the second member 23 contains carbon nanotubes, it is preferable that the second member 23 further contains a material that does not react with the carbon nanotubes. More specifically, it is preferable that the second member 23 further contains at least one selected from the group consisting of graphite, fullerene, diamond, and diamond-like carbon. Furthermore, it is preferable in another example that the second member 23 further contains a carbide of at least one element selected from the group consisting of tungsten, molybdenum, chromium, tantalum, niobium, vanadium, zirconium, titanium, nickel, boron, and silicon (Si).

It is also preferable that the second member 23 contains a material having a fibrous shape. The term "fibrous shape" as used herein refers to material containing a number of elongated components with a high aspect ratio, and the respective longitudinal directions of the components are arranged substantially in one direction. Examples of the fibrous material include a carbon fiber and an aggregate of whisker structures. By using the second member 23 in which such a fibrous material projects from a surface, an electric field can be concentrated on the fibrous material. Thus, by using the second member 23 containing the above-mentioned fibrous material, the electron emission member 14 is obtained that allows electrons to be emitted at a low intensity of an electric field. In this case, it is particularly preferable that the fibrous material is arranged substantially in one direction in the second member 23.

Furthermore, the second member 23 may include a material that contains carbon as its main component. A carbon material is likely to emit electrons and is easy to process. Therefore, when such a carbon material is used, an electron emission element is obtained that has a high electron emission ability and is easy to produce.

Examples of the combination (first member 22/second member 23) satisfying the above conditions include, but are not limited to, (silver/a material containing carbon nanotubes), (aluminum/a mixture of carbon nanotubes and fullerene), (copper/a material containing carbon nanotubes), (silver/a material containing carbon nanotubes), (silver/a mixture of carbon nanotubes and diamond particles), and (copper/a mixture of carbon nanotubes and metal carbide).

Figure 2B:
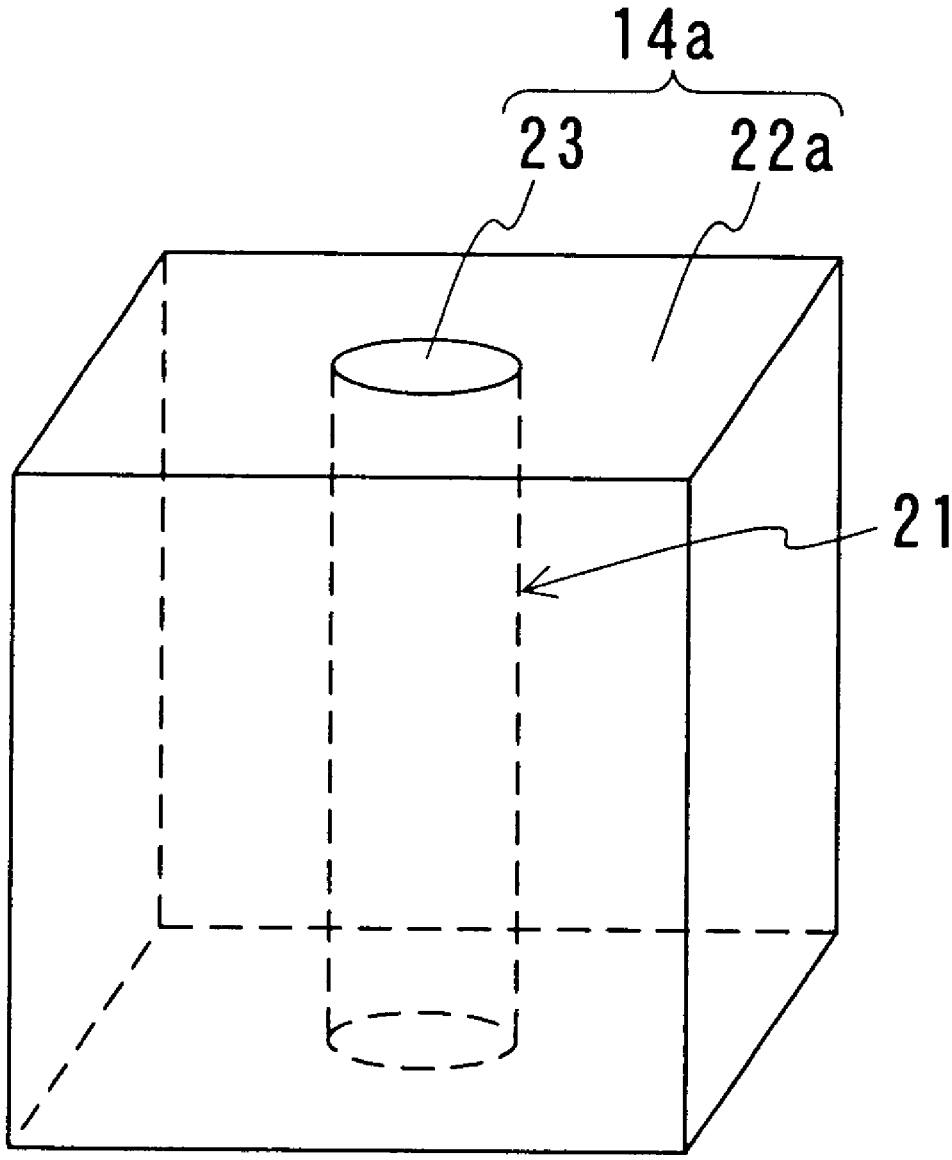
Figure 2C:
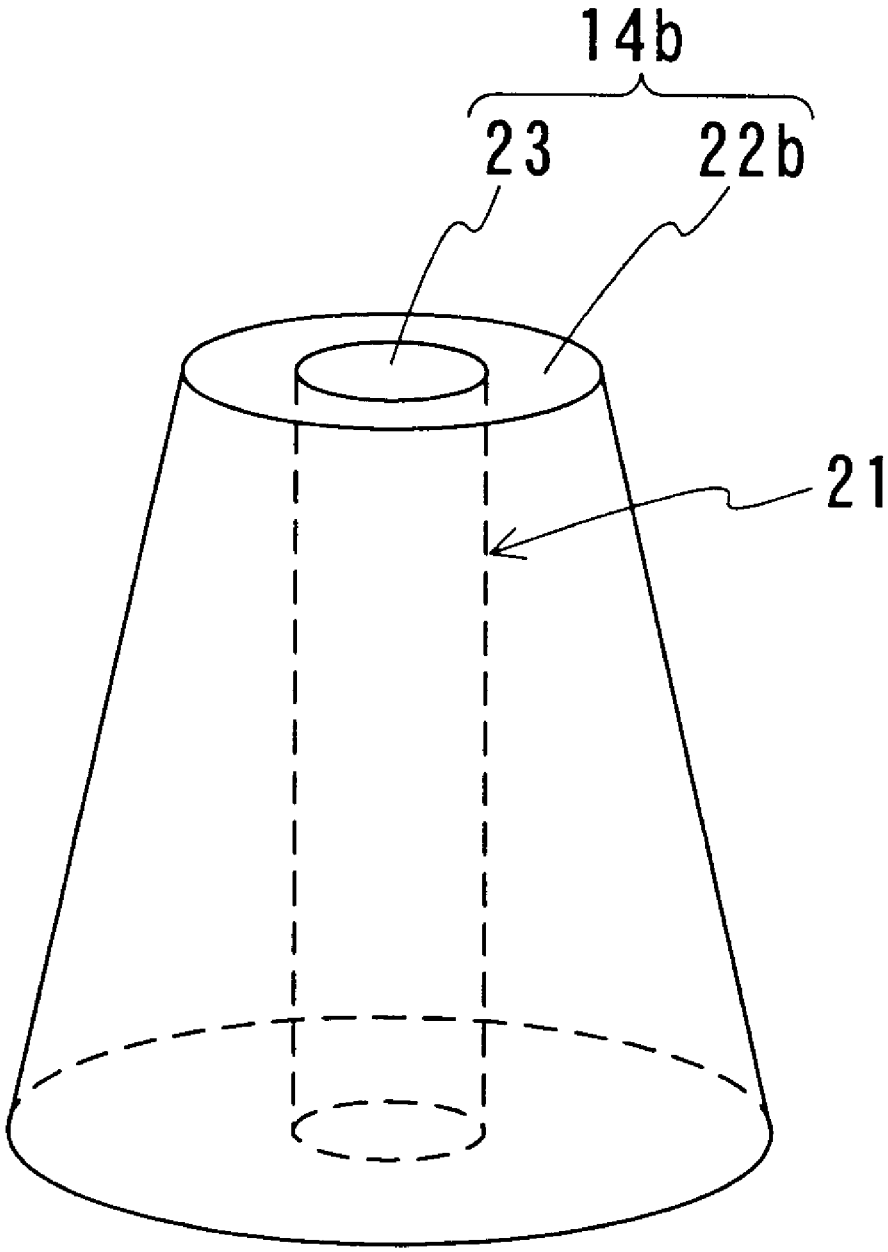
Figure 2D:
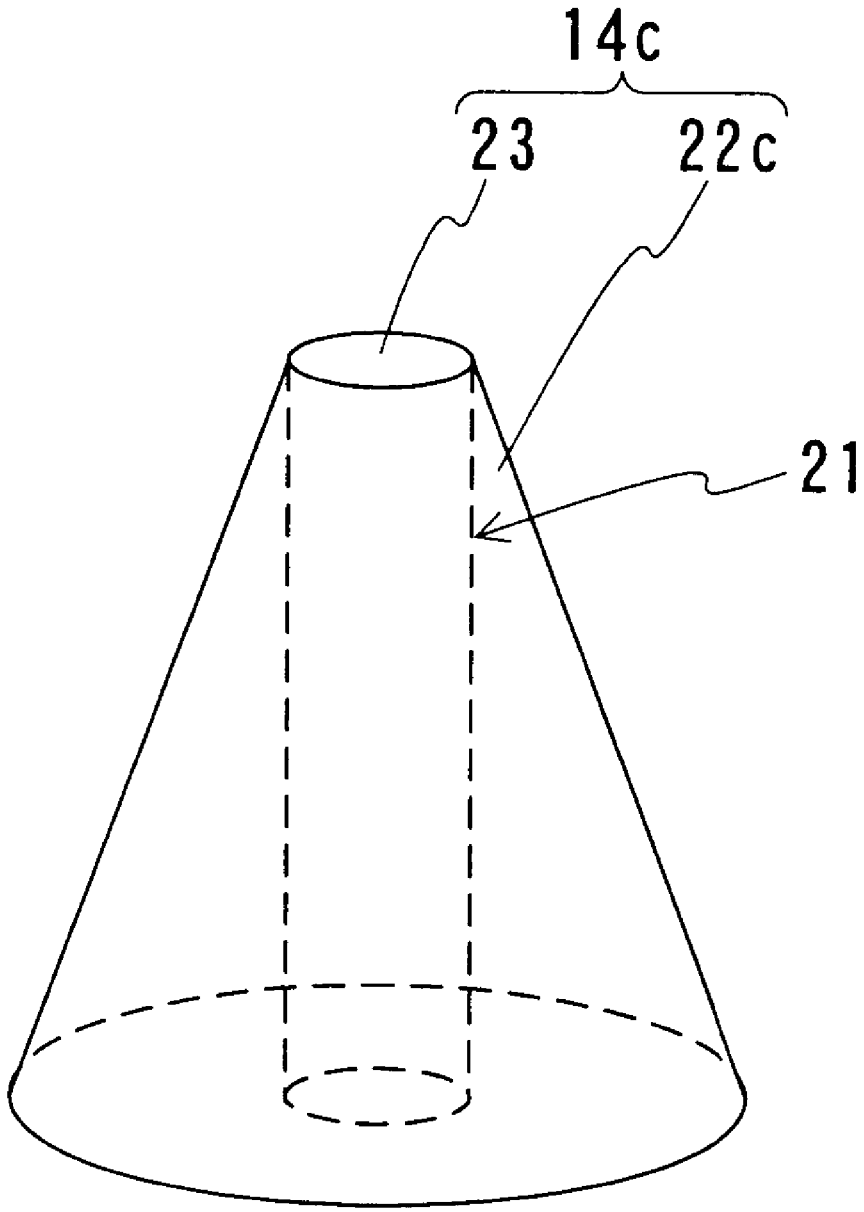
Figure 3:
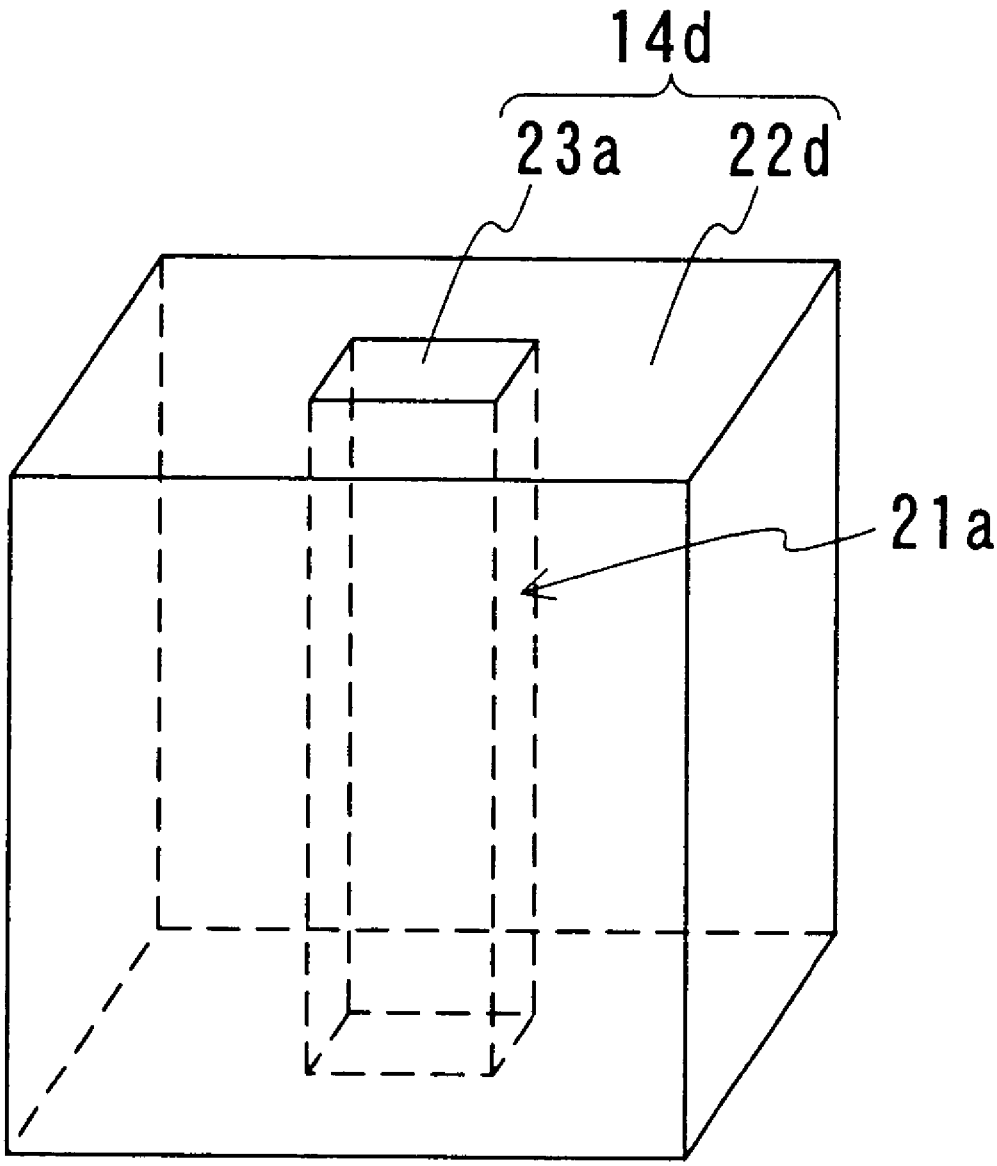
FIG. 3 is a perspective view showing another example of an electron emission member of the electron emission element according to the present invention.

The shape of the electron emission member 14 shown in FIG. 2A is an example. The electron emission member 14 may have another shape. As other examples of the electron emission member 14, FIG. 2B shows an electron emission member 14*a*, FIG. 2C shows an electron emission member 14*b*, FIG. 2D shows an electron emission member 14*c*, and FIG. 3 shows an electron emission member 14*d*. The electron emission member 14 includes the cylindrical first member 22. The electron emission member 14*a* includes a first member 22*a* having a rectangular solid shape. The electron emission member 14*b* or 14*c* includes a truncated first member 22*b* or 22*c*. The electron emission member 14 includes the columnar second member 23. The electron emission member 14*d* includes a second member 23*a* with a rectangular solid shape. The shapes of the first member 22 and the second member 23 are not particularly limited. The use of the cylindrical first member 22 and the columnar second member 23 facilitate production and handling.

Figure 4:
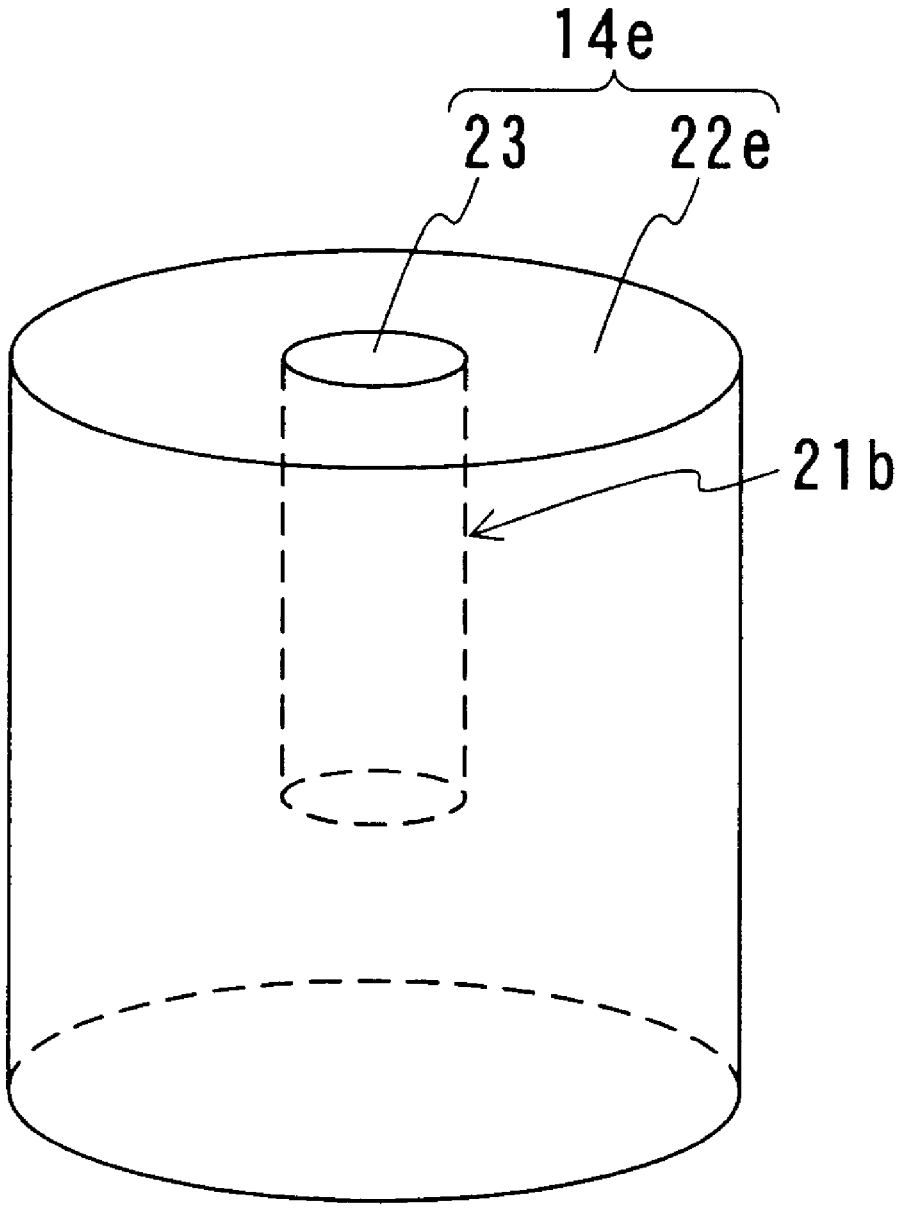
FIG. 4 is a perspective view showing still another example of an electron emission member of the electron emission element according to the present invention.

Furthermore, the hole 21 formed in the first member 22 may not be a through-hole. FIG. 4 shows an electron emission member 14*e* with such a structure. The first member 22*e* of the electron emission member 14*e* includes a hole 21*b* which is not a through-hole, and the second member 23 fills the hole 21*b*. It is also appreciated that the hole 21 may not be a through-hole in the electron emission members 14*a* through 14*d*. In the case where the hole 21 is not a through-hole, the first member 22*e* is required to have conductivity so as to electrically connect the cathode electrode 12 to the electron emission member 14*e*.

Figure 5A:
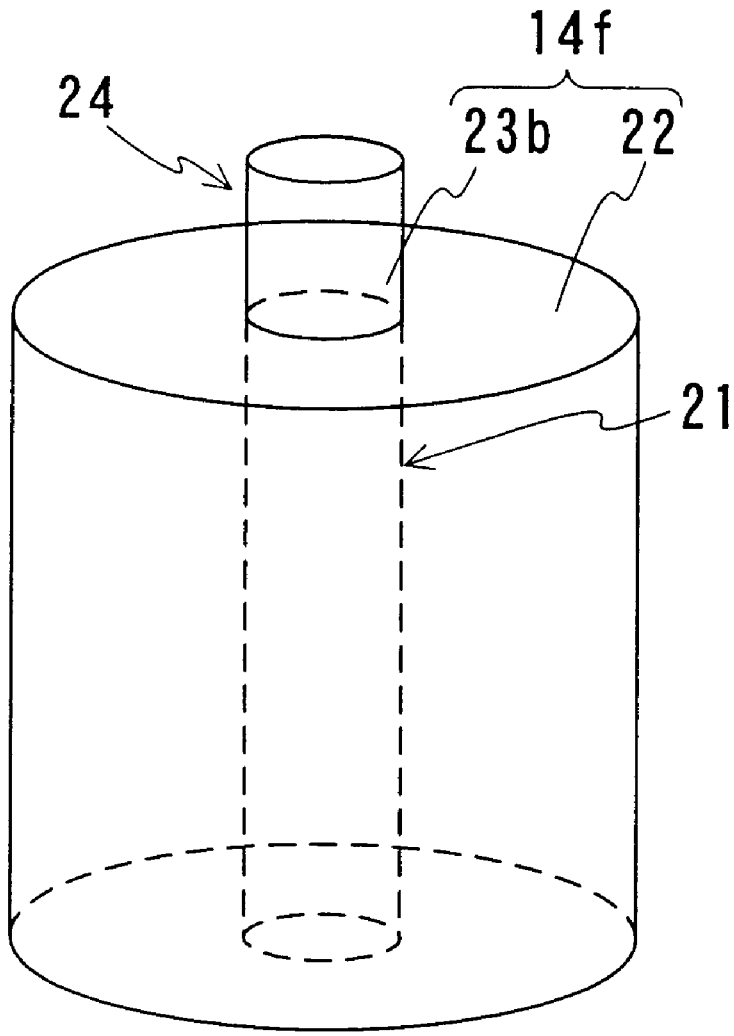
FIGS. 5A and 5B are perspective views each showing still other examples of an electron emission member of the electron emission element according to the present invention.
Figure 5B:
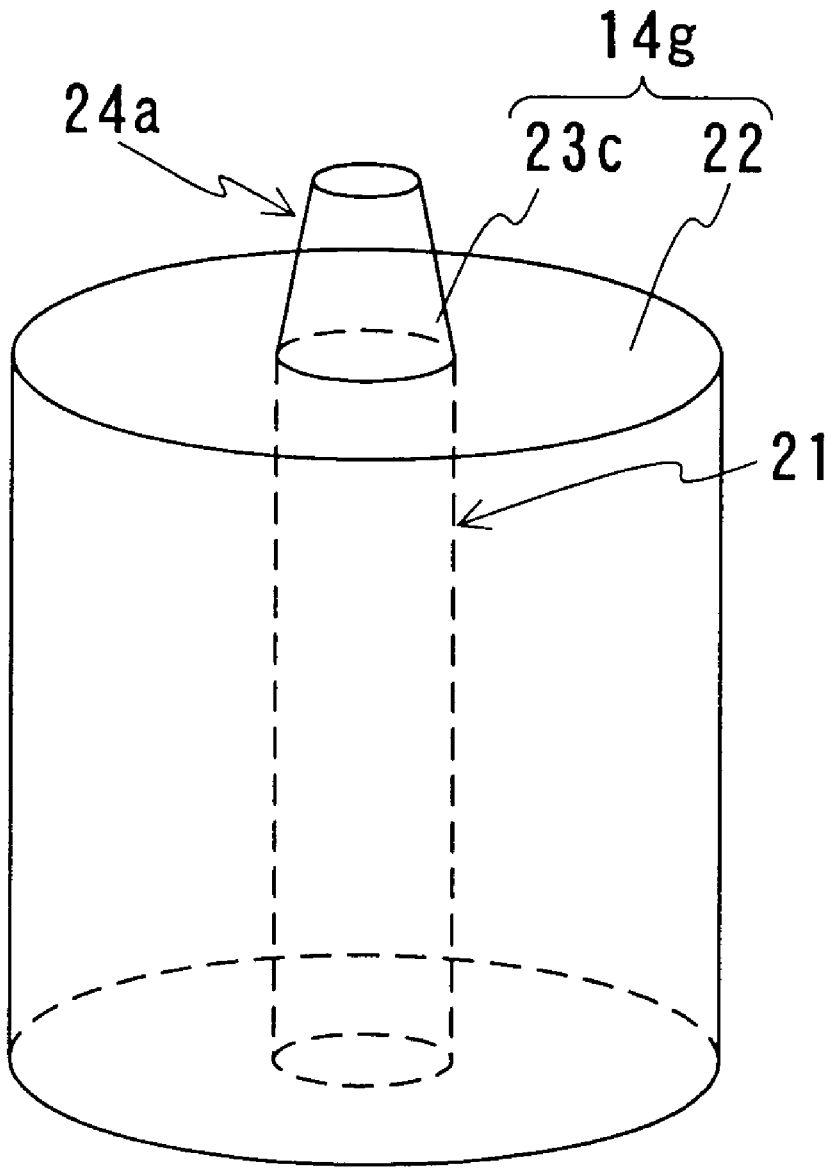

The electron emission member 14 may have a convex portion formed of the second member 23 on the side of the anode electrode 13. As examples of the electron emission member 14 with such a structure, FIG. 5A shows an electron emission member 14*f*, and FIG. 5B shows an electron emission member 14*g*. The electron emission member 14*f* includes a columnar convex portion 24 formed of the second member 23*b*. Furthermore, the electron emission member 14*g* includes a truncated cone convex portion 24*a* formed of the second member 23*c*. The convex portion 24 may have another shape such as a rectangular solid shape. The convex portion 24 can be formed by removing an end portion of the first member 22. The convex portion 24 also can be formed by press-fitting the second member 23 into the hole 21 in such a manner as to allow a part of the second member 23 to project.

Figure 6:
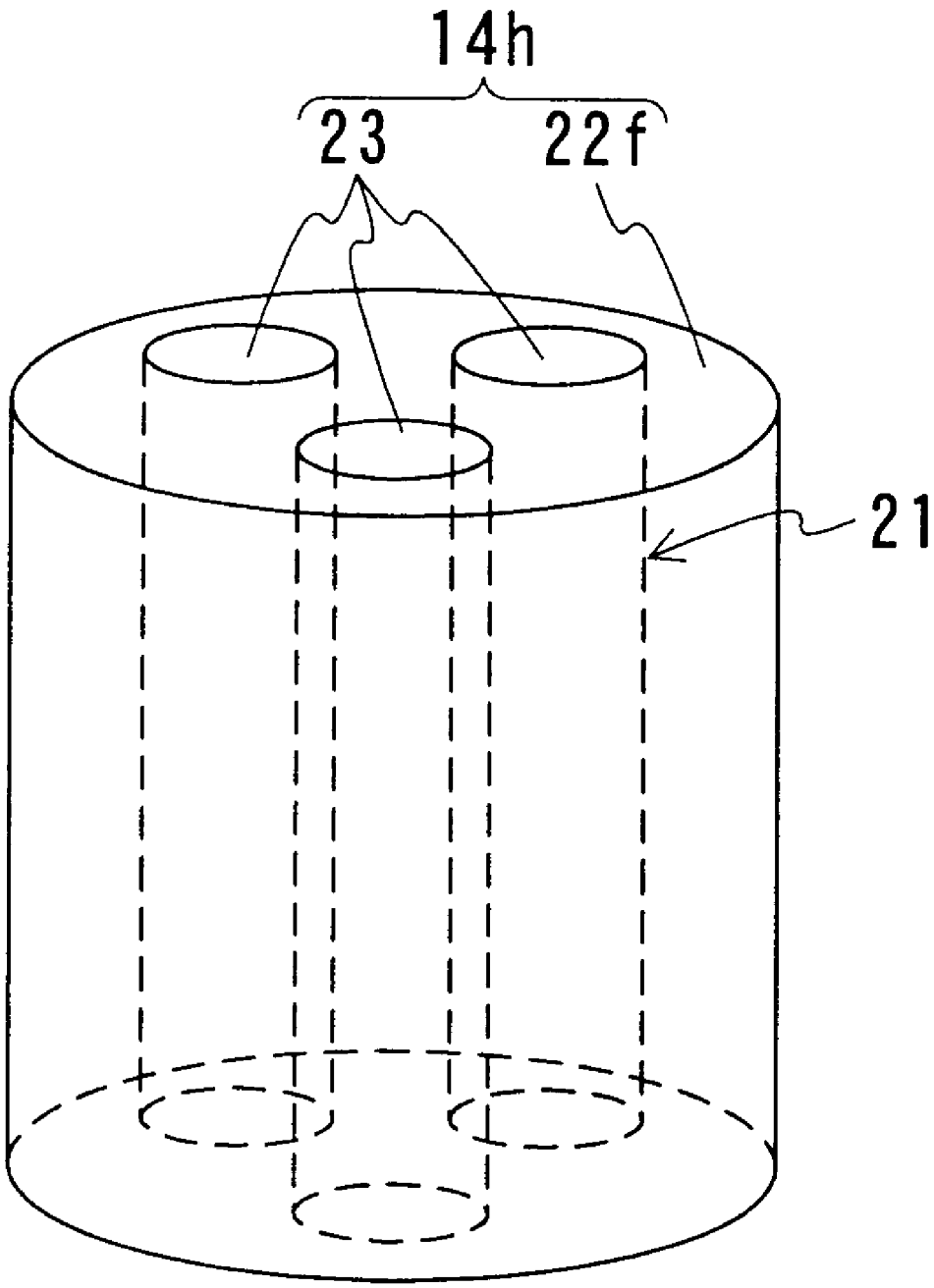
FIG. 6 is a perspective view showing still another example of an electron emission member of the electron emission element according to the present invention.

Furthermore, it is also possible that the first member 22 has a plurality of holes 21, and the second member 23 fills the plurality of holes 21. As an example of the electron emission member 14 with such a structure, FIG. 6 shows an electron emission member 14*h*. A first member 22*f* of the electron emission member 14*h* includes a plurality of holes 21, and the second member 23 fills each hole 21. In the electron emission member 14*h*, the electron emission amount and the electron emission position can be controlled by varying the number and position of the holes 21.

Various variations of the shape of the first member 22, the shape of the second member 23, the number and shape of the holes 21, and the shape and presence/absence of the convex portion 24 can be arbitrarily combined.

In the electron emission element 10 in Embodiment 1, the second member 23 having a high electron emission ability fills the holes 21 formed in the first member 22. This makes it possible to use a material which is difficult to be singularly used due to its difficulty in handling (i.e., the material for the second member 23), and facilitates production of the electron emission element 10. Thus, in Embodiment 1, an electron emission element is obtained that has a high electron emission ability and is easily produced. Furthermore, by forming a plurality of such electron emission elements on the same substrate, an electron emission source with a high electron emission ability can be obtained.

Furthermore, in the electron emission element 10, an electric field can be concentrated on an end facet of the second member 23 by selecting a combination of the first member 22 and the second member 23. Thus, electrons can be taken out of the electron emission member even at a low extraction voltage. More specifically, in Embodiment 1, an electron emission element is obtained that is capable of emitting electrons with high stability and high efficiency.

Figure 14:
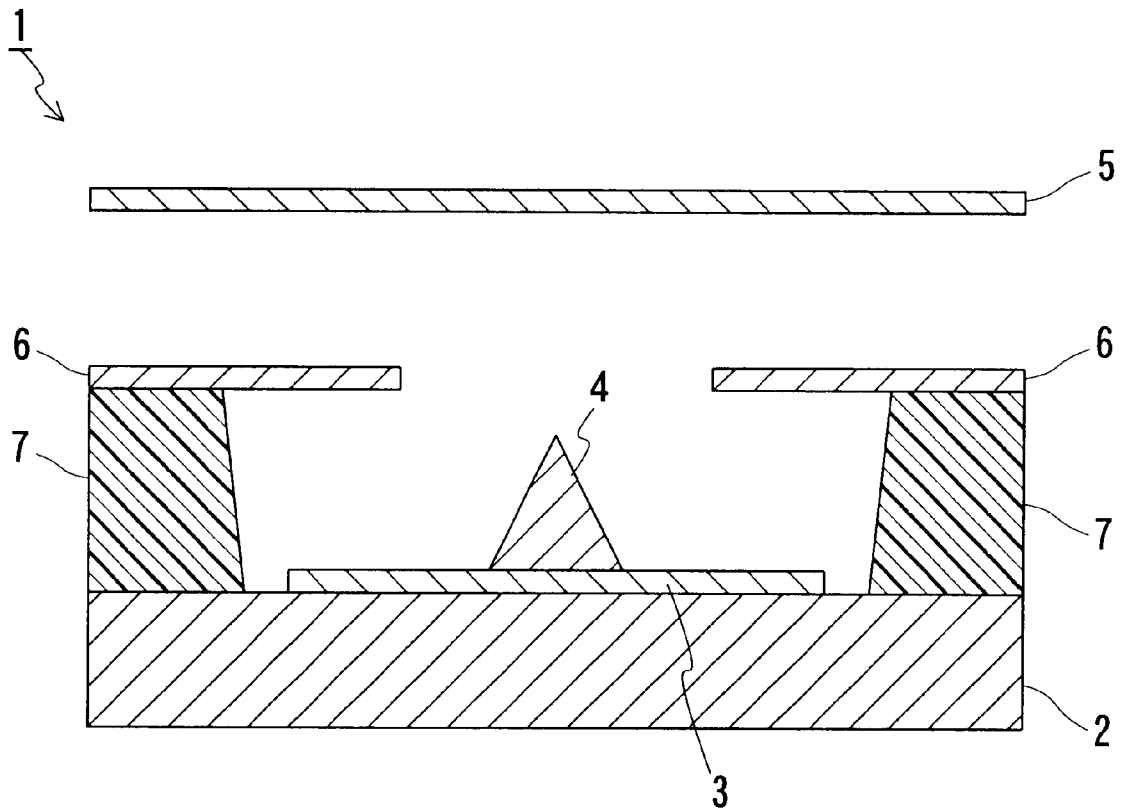
Fig.14 PRIOR ART
FIG. 14 is a cross-sectional view showing an example of a conventional electron emission element.

For example, in the conventional electron emission element 1 (see FIG. 14), electrons are emitted only from the vicinity of a tip end of the cone-shaped electron emission member 4. Furthermore, the electron emission characteristics are largely affected by the shape of the tip end and the surface state of the electron emission member 4. In contrast, in the electron emission element 10 in Embodiment 1, electrons are efficiently emitted from the end facet of the second member 23, so that an electron emission current can be obtained even under a low electric field. Furthermore, the second member 23 has a high electron emission ability, and its electron emission is less dependent upon the shape of the second member 23. Therefore, stable electron emission characteristics can be maintained.

FIG. 1 shows an example of the electron emission element. An electron emission element may have any structure, as long as it uses the above-mentioned electron emission members.

Figure 7:
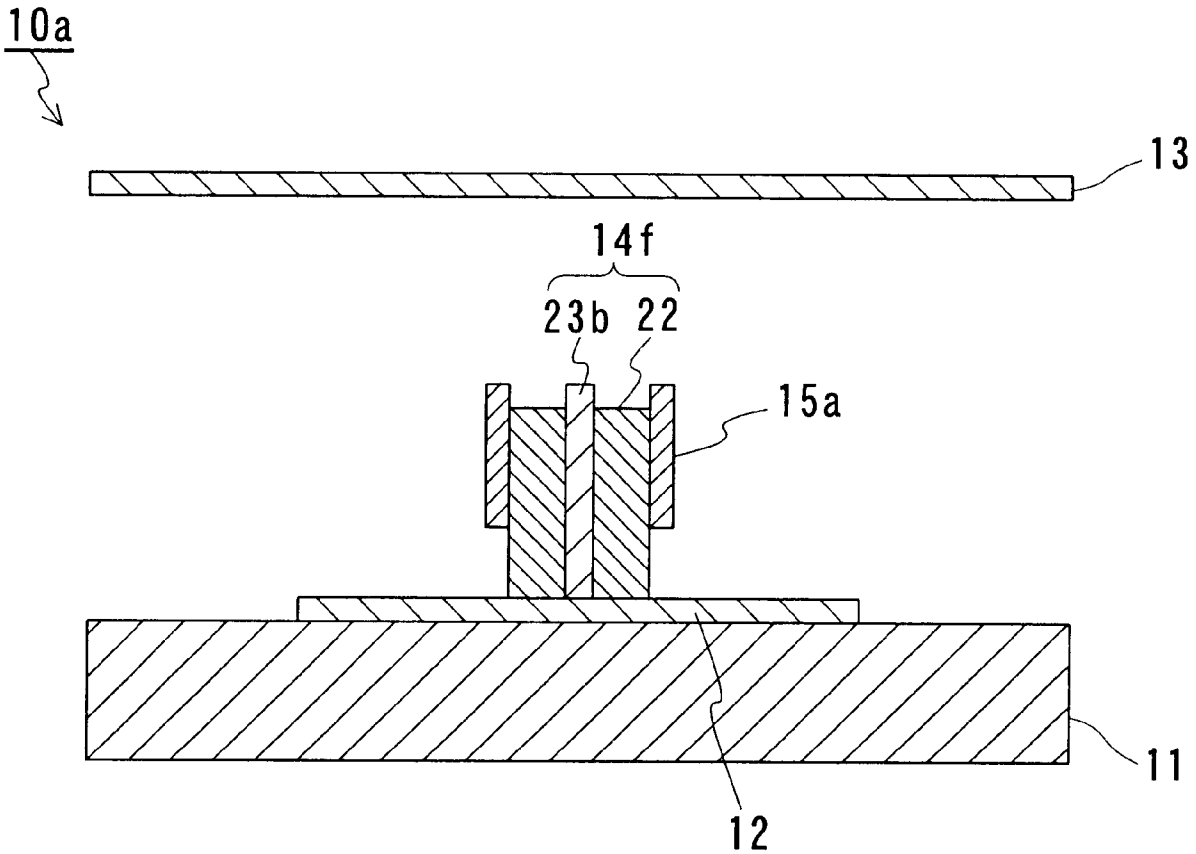
FIG. 7 is a cross-sectional view showing another example of an electron emission element according to the present invention.
Figure 8:
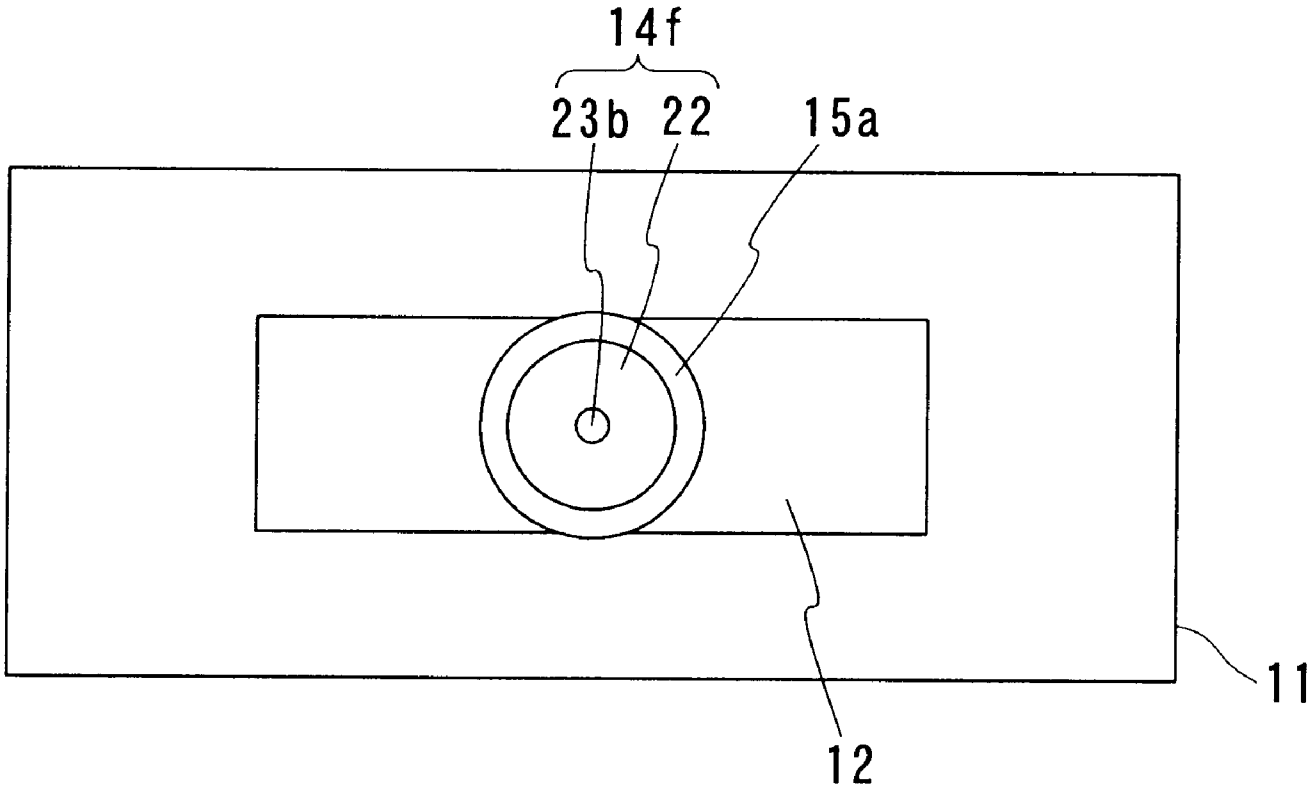
FIG. 8 is a plan view showing a part of the electron emission element shown in FIG. 7.

Furthermore, in the electron emission element of the present invention, a control electrode may be formed on the electron emission member 14 (including the variations of the electron emission members 14*a* through 14*h*). FIG. 7 is a cross-sectional view showing an example of such an electron emission element 10*a*. FIG. 8 is a plan view of the substrate 11 seen from the anode electrode 13 side.

The electron emission element 10*a* includes a substrate 11, a cathode electrode 12 formed on the substrate 11, an anode electrode 13 disposed so as to be opposed to the cathode electrode 12, an electron emission member 14*f* disposed on the cathode electrode 12, and a control electrode 15*a* formed on an outer periphery of the electron emission member 14*f* The control electrode 15*a* has, for example, a cylindrical shape. Herein, the control electrode 15*a* is required to be electrically insulated from the second member 23. Thus, in the case where the control electrode 15*a* is directly formed on the electron emission member 14*f*, the first member 22 must be an insulator. Furthermore, in the case where the first member 22 is made of a conductive material, it is required to form an insulating layer between the first member 22 and the control electrode 15*a*. The portions other than the first member 22 and the control electrode 15*a* are the same as those of the electron emission element 10, so that their description will be omitted.

Even in the electron emission element 10*a*electrons are allowed to be emitted from the electron emission member 14*f* by controlling an electric potential of the control electrode 15*a*.

In the electron emission element 10*a*, another electron emission member described in Embodiment 1 may be used in place of the electron emission member 14*f*.

Embodiment 2

In Embodiment 2, a method for producing an electron emission element according to the present invention will be described. According to the method for producing an electron emission element in Embodiment 2, the electron emission element in Embodiment 1 can be easily produced.

In Embodiment 2, a method for producing an electron emission element including a cathode electrode, an anode electrode disposed so as to be opposed to the cathode electrode, and an electron emission member disposed on the cathode electrode, includes the step of filling a substantially cylindrical body made of a first material with a second material different from the first material, followed by drawing and cutting, thereby forming an electron emission member including a first member with a through-hole and a second member that fills the through-hole and is more likely to emit electrons than the first member.

Figure 9A:
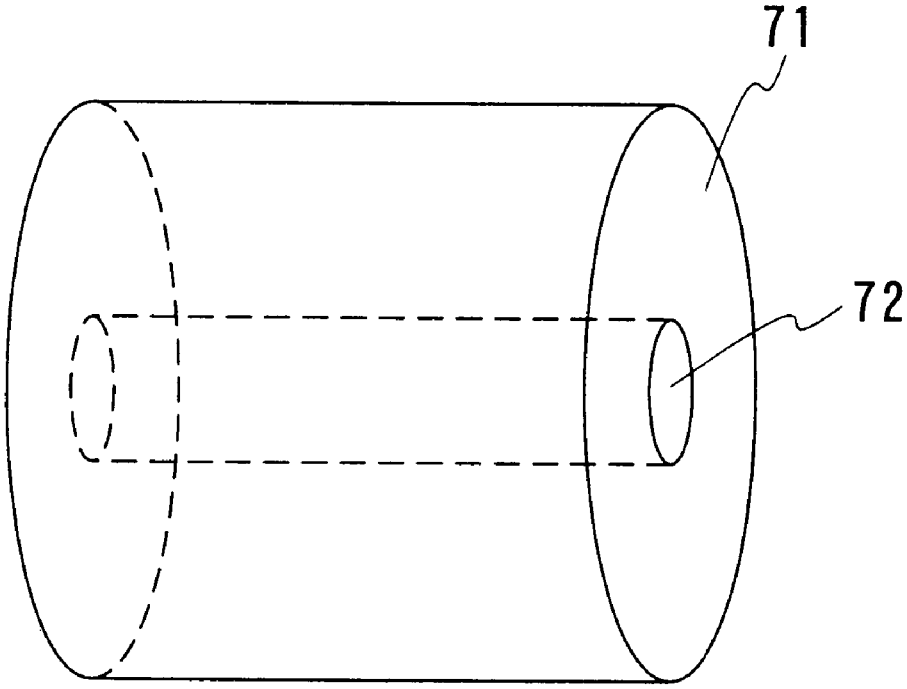
FIGS. 9A and 9B schematically show an example of the steps of producing an electron emission element according to the present invention.

Hereinafter, the method in Embodiment 2 will be described with reference to FIGS. 9A and 9B. First, as shown by a perspective view in FIG. 9A, a cylindrical body 71 made of a first material is filled with a second material 72 different from the first material. The first material is to form the first member 22 described in Embodiment 1, and the material for the first member 22 described in Embodiment 1 can be used. Metal is preferably used for the first material. Due to good process ability, metal easily can be drawn.

The second material is to form the second member 23 described in Embodiment 1, and the material for the second member 23 described in Embodiment 1 can be used.

A filling method is not particularly limited. The cylindrical body 71 may be filled with the second material 72 in a powder shape. Furthermore, it is also possible that the second material 72 in a fluid state kneaded with a binder is injected to the cylindrical body 71, and thereafter, the binder component is removed. Furthermore, the second material 72 previously molded into a columnar shape may be press-fit into the cylindrical body 71.

Figure 9B:
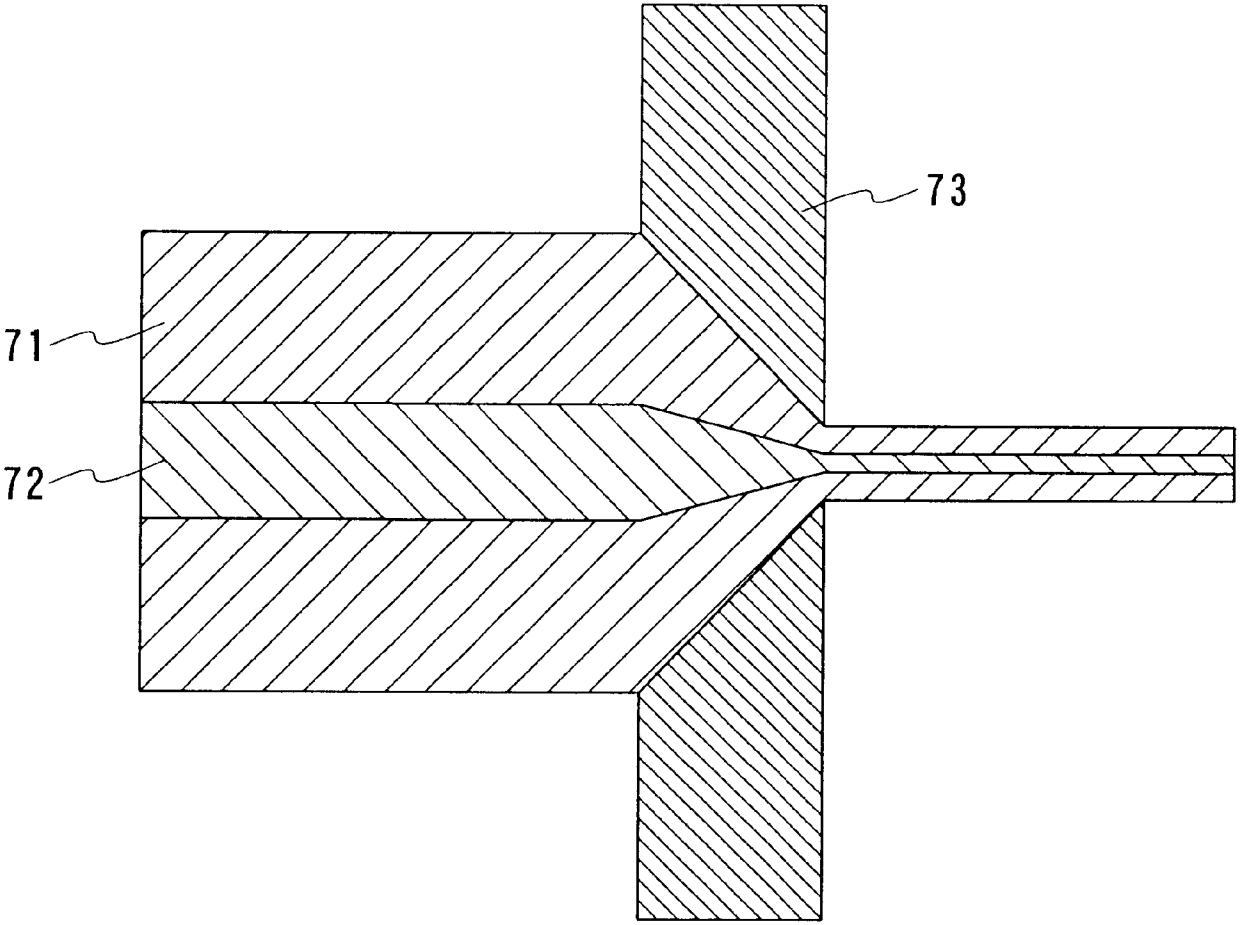

Next, the cylindrical body 71 filled with the second material 72 is drawn by using a drawing device 73 (see a cross-sectional view in FIG. 9B). By conducting drawing, the electron emission member 14 with a desired diameter can be formed. Furthermore, by conducting drawing, the second material 72 filling the cylindrical body 71 is allowed to have a dense structure. Furthermore, by repeating drawing, the electron emission member 14 with a small diameter easily can be formed.

Next, the drawn cylindrical body 71 is cut to a predetermined length, whereby the electron emission member 14 can be produced.

In the case of producing the electron emission member 14*h* shown in FIG. 6, a plurality of the cylindrical bodies 71 each filled with the second material 72 should be drawn in a bundle.

In the case of producing the electron emission member 14*f* or 14*g* provided with the convex portion 24, the first member 22 of the electron emission member 14 should be partially removed. Apart of the first member 22 can be easily removed by soaking the first member 22 in a particular solution or by mechanically grinding a part of the first member 22.

The above-mentioned electron emission member (including that before cutting) may be heated at 400° C. to 700° C. By heat-treating the electron emission member, the second member filling the first member can be stabilized and an electron emission ability of the second member can be enhanced.

Hereinafter, a drawn state will be described with reference to FIG. 10, regarding the case where the second material 72 contains carbon nanotubes. Each carbon nanotube has a diameter of an end portion of 1 nm to 50 nm, and a length in a longitudinal direction of about 0.5$\mu$m to about 3 $\mu$m. It has been difficult conventionally to fill the cylindrical body 71 with such microscopic carbon nanotubes in such a manner that they are arranged in one direction. However, according to the method of the present invention, carbon nanotubes easily can be arranged substantially in one direction.

Figure 10:
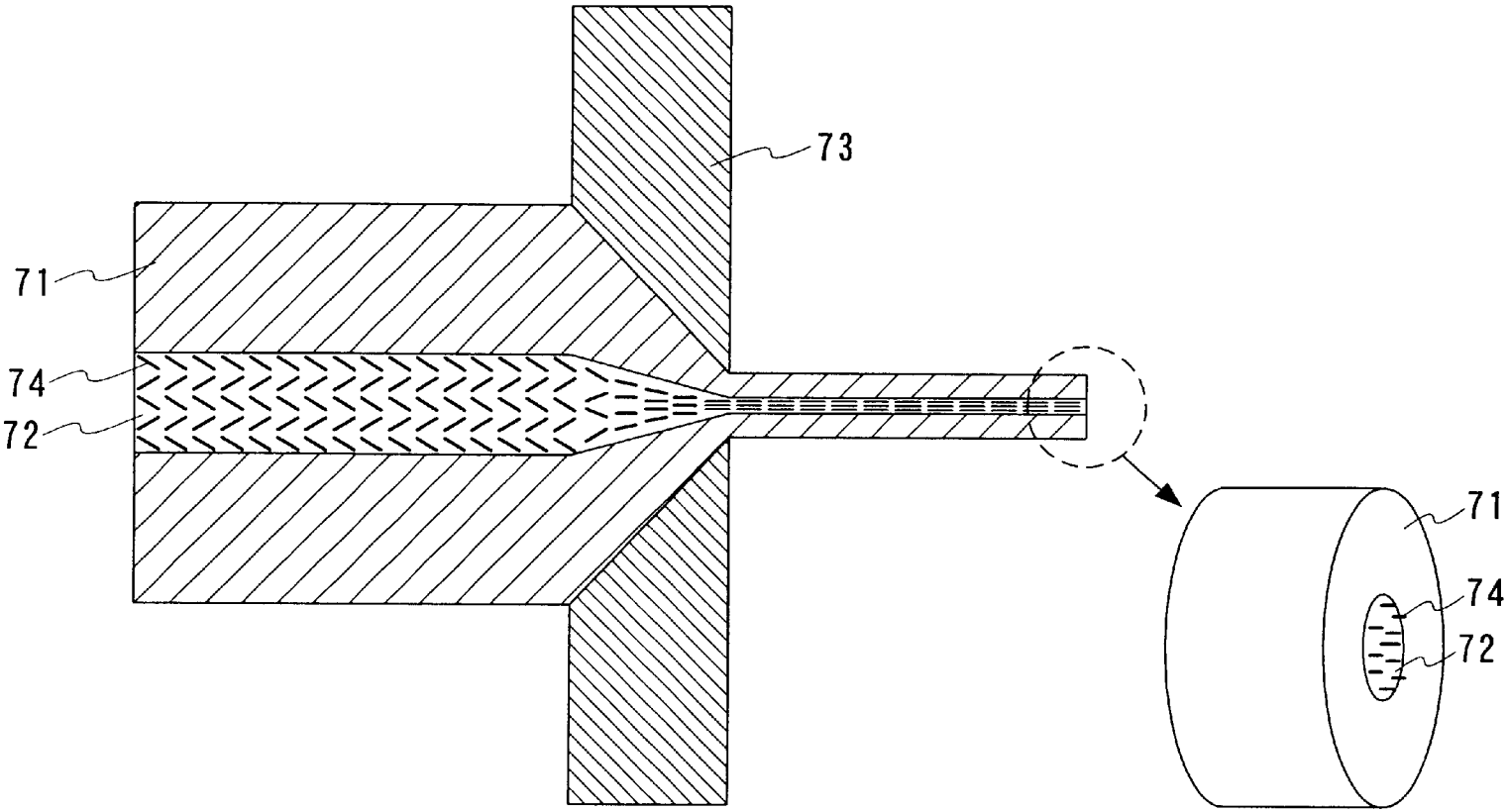
FIG. 10 schematically shows another example of the steps of producing an electron emission element according to the present invention.

As shown in FIG. 10, before drawing, the carbon nanotubes 74 are randomly dispersed in the second material 72. However, as shown by an enlarged view in FIG. 10, the carbon nanotubes 74 are arranged substantially in one direction by drawing. Therefore, according to the above-mentioned drawing, the end portions of the carbon nanotubes, which are considered to be likely to emit electrons, selectively can be disposed on an end facet of the electron emission member. Thus, by drawing the second material 72 containing carbon nanotubes to form an electron emission member, an electron emission element easily can be produced, which has a particularly high electron emission ability and a small spread of an emission electron flow. The same effects are obtained even in the case of using the second material 72 containing another material (e.g., fibrous material described in Embodiment 1) that has a large aspect ratio and is likely to emit electrons, in place of carbon nanotubes.

According to the method for producing an electron emission element of the present invention, the cathode electrode 12, the control electrode 15, and the insulating layer 16 are formed on the substrate 11, along with production of the above-mentioned electron emission element. The cathode electrode 12, the control electrode 15, and the insulating layer 16 respectively can be formed to a predetermined shape, for example, by forming a thin film by sputtering, vacuum evaporation, etc., followed by photolithography and etching.

Thereafter, the electron emission member 14 formed during the above-mentioned step is disposed on the cathode electrode 12 formed on the substrate 11. The anode electrode 13 is disposed so as to be opposed to the substrate 11, whereby the electron emission element 10 can be formed (see FIG. 1).

According to the production method in Embodiment 2, an electron emission element with a high electron emission ability can be easily produced.

A method for producing the electron emission member 14 is not limited to the above-mentioned method. The electron emission member 14 can be produced by various methods. For example, the hole 21 of the first member 22 may be filled with the material for the second member 23. Alternatively, the previously molded second member 23 may be press-fit into the hole 21 of the first member 22.

Embodiment 3

In Embodiment 3, a light-emitting device of the present invention will be described.

Figure 11:
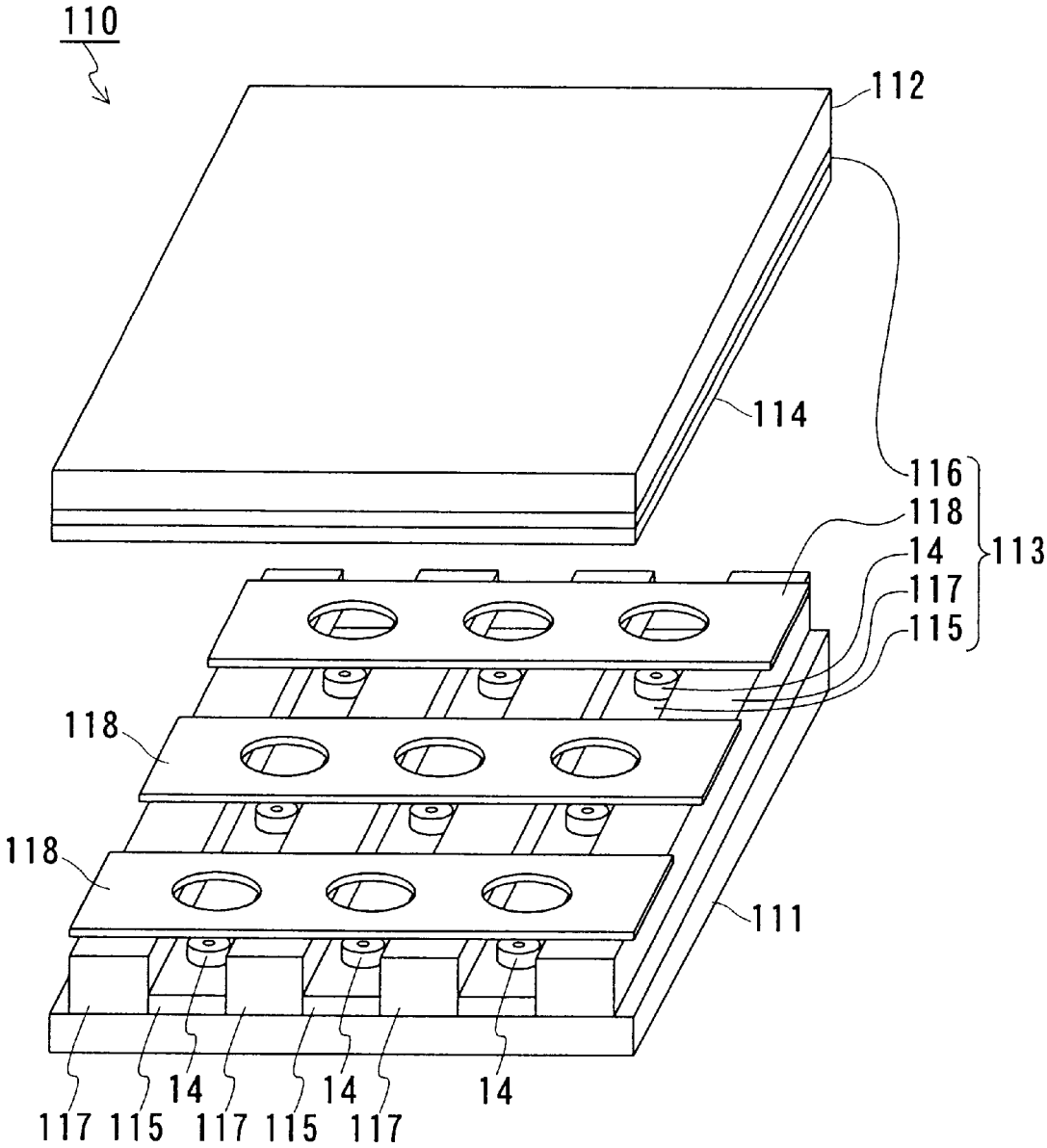
FIG. 11 is an exploded perspective view showing an example of a light-emitting device according to the present invention.

A light-emitting device of the present invention includes a substantially vacuum container, and a plurality of electron emission elements disposed in the container, wherein the electron emission element is the one described in Embodiment 1, and a phosphor film is further disposed between the electron emission member of the electron emission element and the anode electrode thereof In the light-emitting device of the present invention, each control electrode of a plurality of electron emission elements may be independently controlled. Due to the above-mentioned structure, an image output device is obtained. FIG. 11 is an exploded perspective view showing an example of the image output device 110 (an example of the light-emitting device of the present invention).

Referring to FIG. 11, the image output device 110 includes a first substrate 111, a second substrate 112 disposed so as to be opposed to the first substrate 111, a plurality of electron emission elements 113 disposed between the first substrate 111 and the second substrate 112, and a phosphor film 114 disposed on the second substrate 112. Each light emission element 113 corresponds to the one described in Embodiment 1. More specifically, each electron emission element 113 includes a cathode electrode 115 disposed on the first substrate 111, an electron emission member 14 (including variations of the electron emission members 14*a* through 14*h*) disposed on the cathode electrode 115, an anode electrode 116 formed on the second substrate 112, an insulating layer 117, and a control electrode 118 formed on the insulating layer 117. Herein, the cathode electrode 115 is composed of a plurality of cathode electrodes 12 arranged in parallel. Similarly, the control electrode 118 is composed of a plurality of control electrodes 15 arranged in parallel so as to cross the cathode electrodes 115. The phosphor film 114 is disposed between the electron emission members 114 and the anode electrode 116.

The image output device 110 further includes a side wall (not shown) formed on an outer edge of the first substrate 111 and the second substrate 112. In the image output device 110, a space formed by the first substrate 111, the second substrate 112, and the side wall has an airtight structure (airtight container), and hence, a substantially vacuum state can be maintained. More specifically, the image output device 110 includes a plurality of electron emission elements disposed in the airtight container. The substantially vacuum state of the airtight container can be achieved by sealing a connecting portion of each component member, for example, with frit glass, and further exhausting the airtight container. More specifically, the above-mentioned airtight container is assembled, thereafter, an exhaust pipe and a vacuum pump are connected to the airtight container, and the airtight container is exhausted to about $10^{-7}$ Torr. Then, the exhaust pipe is sealed. At this time, it is preferable that a getter film containing, for example, barium as its main component is formed at a predetermined position in the airtight container. By forming a getter film, a vaccum degree in the vacuum container can be maintained at $1\times10^{-5}$ Torr to $1\times10^{-7}$ Torr even after the airtight container is sealed.

Next, the arrangement of the electron emission elements 113 will be described. On the first substrate 111, n columns (n is an integer of 2 or more, and is determined in accordance with the number of intended display pixels.

In FIG. 11, n=3) of cathode electrodes 115 are arranged. On the insulating layers 117, m columns (m is an integer of 2 or more, and is determined in accordance with the number of intended display pixels. In FIG. 11, m=3) of the control electrodes 118 are disposed so as to cross the cathode electrodes 115. On the cathode electrodes 115, n×m electron emission members 14 are disposed in a matrix at positions where n lines (cathode electrodes 115) in the column direction cross m lines (control electrodes 118) in the row direction.

In the case where a monochrome display is performed by using the image output device 110, one kind of fluorescent substance should be used for the phosphor film 114. Furthermore, in the case where a color display is performed by using the image output device 110, it is required to use a plurality of kinds of fluorescent substances (e.g., fluorescent substances corresponding to three primary colors of red, green, and blue used in the field of CRTs (cathode ray tubes)) for the phosphor film 114. In this case, generally, a fluorescent substance corresponding to each color is formed in a stripe shape, and a black conductor (graphite, etc.) is formed between the stripes of the fluorescent substances of the respective colors, for the purpose of preventing a decrease in contrast.

Figure 12:
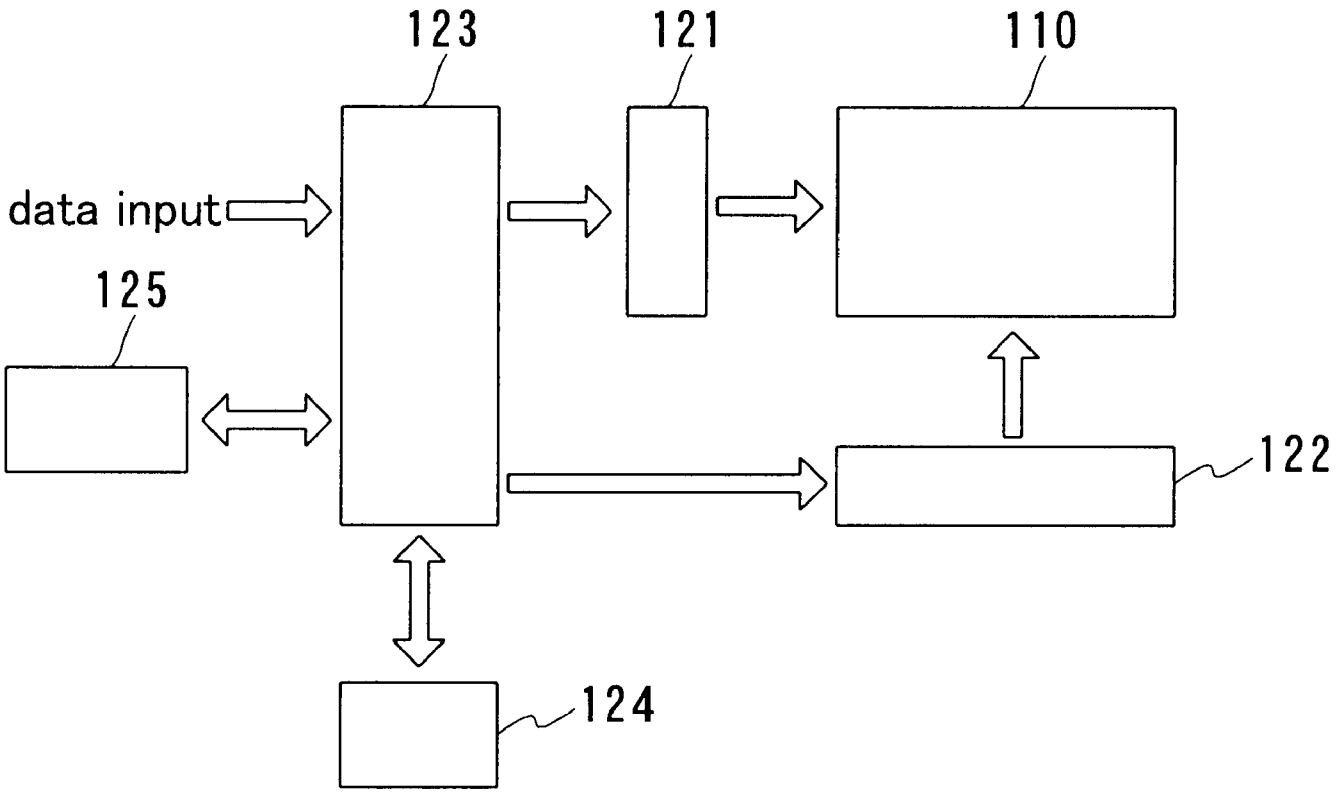
FIG. 12 is a view showing an example of a structure of a control system for a light-emitting device according to the present invention.

Next, a method for controlling the image output device 110 will be described. FIG. 12 schematically shows a control system of the image output device 110. A scan driver 121 is electrically connected to the control electrodes 118 of the image output device 110. The scan driver 121 applies a scanning signal, for successively driving m lines of control electrodes 118 one by one, to the control electrodes 118.

On the other hand, a data driver 122 is electrically connected to the cathode electrodes 115 of the image output device 110. The data driver 122 applies a modulation signal (image signal) for controlling an emission amount of electrons to each of n columns of cathode electrodes 115. In the image output device 110, an emission amount of electrons from each electron emission element 113 can be controlled by controlling the scanning signal and the modulation signal. Thus, in the image output device 110, the phosphor film 114 is allowed to emit light so as to correspond to a position of each electron emission element 113, whereby an image can be displayed.

The scan driver 121 and the data driver 122: are connected to the control circuit 123 for controlling them. Furthermore, the control circuit 123 is connected to a memory 124 and a control power source 125. The memory 124 is provided with a ROM (read-only memory) and a RAM (random-access memory) for storing programs and data. Furthermore, a power source (not shown) is connected to the anode electrodes 116 of the image output device 110 for the purpose of accelerating electrons to apply a voltage for irradiation to the phosphor film 114.

Next, a method for driving the image output device 110 will be described. The scan driver 121 contains m switching elements. The switching elements switch on/off an output voltage that is output from a DC power source and applied to each control electrode 118. A value of the output voltage is selected so that a voltage applied to an electron emission member in a row not selected by scanning becomes a threshold voltage or less at which the electron emission member emits electrons. Each switching element of the scan driver 121 is switched based on a timing signal. Furthermore, an image signal input for drawing an image is converted into a pulse signal having a pulse width corresponding to the intensity of the image signal by the control circuit 123, and then is applied to the cathode electrode 115 of the image output device 110 through the data driver 122. The electron emission members 14 under the control electrode 118 selected by the scan driver 121 emit electrons only for a period of time corresponding to a pulse width supplied from the data driver 122. More specifically all the electron emission members 14 in the selected line (control electrode 118) emit electrons in accordance with an image signal. The emitted electrons allow the phosphor film 114 to emit light. Each line (control electrode 118) is successively scanned by the scan driver 121, whereby: the image output device 110 displays a two-dimensional image.

In Embodiment 3, since the electron emission element of the present invention is used, a light-emitting device with a high intensity of light emission and a low power consumption can be obtained.

Furthermore, by applying the light-emitting device of the present invention to the image output device, a flat display with a low power consumption can be obtained.

The image output device 110 described in the above-mentioned embodiment is an example. Any other light-emitting device may be used, as long as it uses the electron emission element of the present invention.

For example, a metal back layer or the like, which is generally used in the field of CRTs, may be formed on the phosphor film 114 of the image output device 110. By forming a metal back layer, a part of light emitted from the phosphor film 114 is reflected from a mirror surface to enhance light use efficiency. Furthermore, by forming a metal back layer, a phosphor film can be protected from bombardment of negative ions.

EXAMPLES

Hereinafter, the present invention will be described by way of illustrative examples.

Example 1

Example 1 is the case where the electron emission member 14 was produced by using cylindrical metal for the first member 22 and a material containing carbon nanotubes for the second member 23.

First, DC arc discharge was allowed to occur between electrodes made of carbons in a helium (He) gas atmosphere. At this time, the material containing carbon nanotubes was collected from a material deposited on the negative electrode. Experimental conditions were He pressure: 40 Torr, purity of a carbon electrode: 99.999%, DC arc discharge voltage: 25 volts, and discharge current: 300 A. A number of carbon nanotubes are generally present in a columnar structure portion in the deposition on the negative electrode, so that only a part of them was collected and pulverized in a mortar. Thus, the material containing carbon nanotubes to be the second member was obtained. The content of the carbon nanotubes in this sample was 5 to 10% by volume.

This sample was loaded into a cylinder of silver (diameter: 6 mm, thickness: 0.5 mm) to be the first member, and both ends of the cylinder were sealed with rubber plugs. The cylinder of silver was subjected to drawing until its diameter became 0.5 mm. In this stage, the diameter of the material containing carbon nanotubes was about 0.3 mm. The linear electron emission material thus formed was cut into a length of 1 mm to obtain an electron emission member 14.

Figure 13:
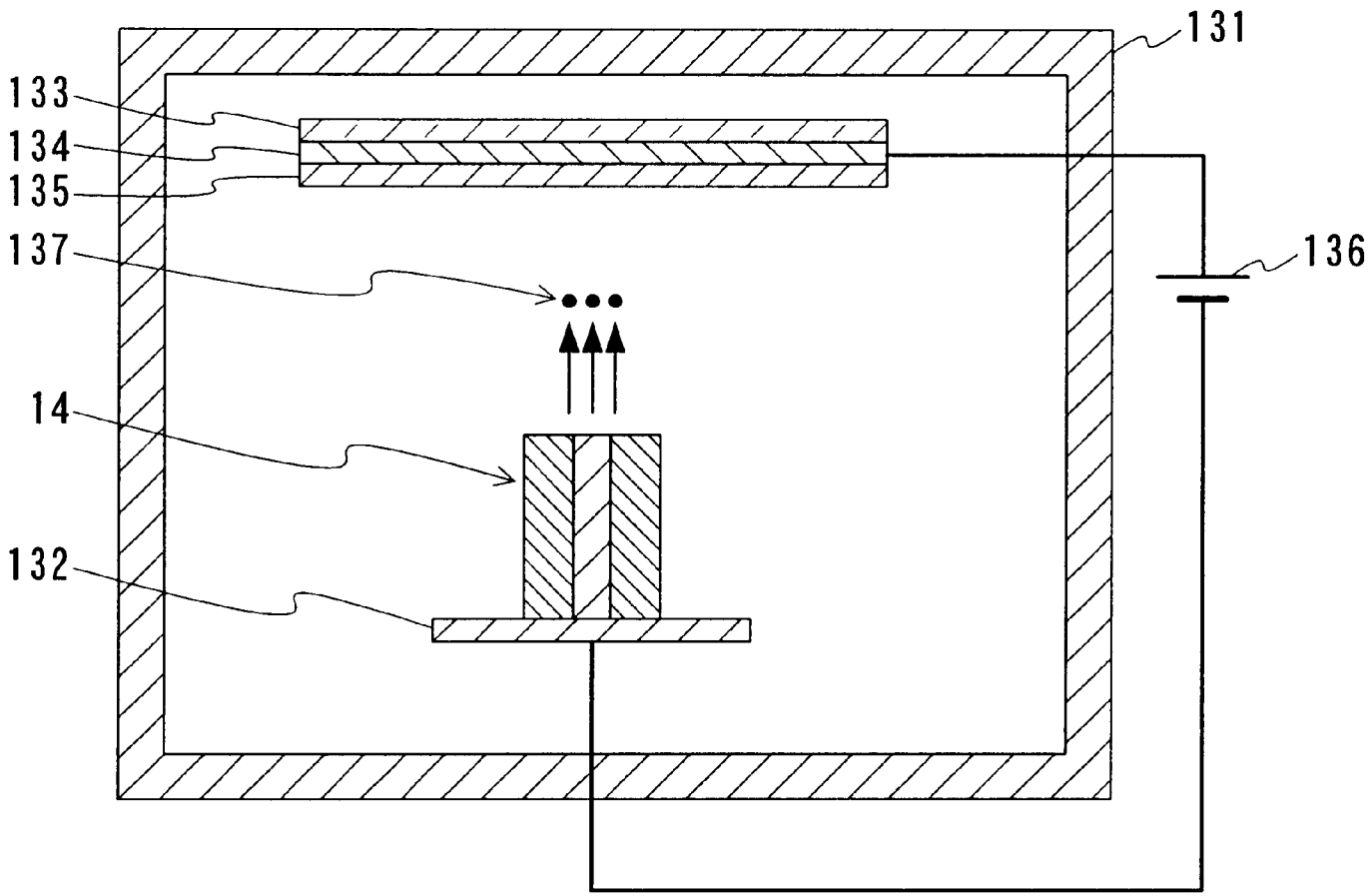
FIG. 13 is a view showing an evaluation device for evaluating electron emission characteristics of an electron emission member used in an electron emission element according to the present invention.

The electron emission member 14 was evaluated for electron emission characteristics by using an evaluation device shown in FIG. 13. The evaluation device in FIG. 13 includes a vacuum chamber 131, a cathode electrode 132 disposed in the vacuum chamber 131, a glass substrate 133 disposed so as to be opposed to the cathode electrode 132, an anode electrode 134 formed on the glass substrate 133, a phosphor film 135 formed on the anode electrode 134, and a DC power source 136 connected to the cathode electrode 132 and the anode electrode 134.

The electron emission member 14 was disposed on the cathode electrode 132 of the evaluation device. A voltage was applied between the cathode electrode 132 and the anode electrode 134 by the DC power source 136. An electric field was applied to an end facet of the electron emission member 14 on which the material containing carbon nanotubes was exposed, and emission of electrons from the material containing carbon nanotubes was observed. Since the material containing carbon nanotubes was loaded into the cylinder of silver, an emission electron flow 137 traveled substantially in a straight line, and allowed a micro-point of the phosphor film 135 to emit light. In the above evaluation, a distance between the end facet of the electron emission member 14 and the anode electrode 134 was set at 1 mm, and a voltage of 2 kV was applied between the electron emission member 14 and the anode electrode 134. Thus, a field emission current of 100 $\mu$A or more flowed.

In the present example, the case has been described, in which the material containing carbon nanotubes to be the second member contained 5 to 10% by volume of carbon nanotubes. However, it was confirmed that if the material contains 1% by volume or more of carbon nanotubes, a practically sufficient emission current is obtained by application of an electric field.

Example 2

Example 2 is the case where the electron emission member 14 was produced by using a material containing purified carbon nanotubes for the second member and cylindrical metal for the first member.

First, under the same conditions as those in Example 1, DC arc discharge was allowed to occur between electrodes made of carbons in a helium (He) gas atmosphere. At this time, a material (the material containing carbon nanotubes) deposited on the negative electrode was collected. Thereafter, a columnar structure portion was collected from the deposition on the negative electrode thus obtained, and pulverized in a mortar. The powders thus obtained were mixed with ethanol, and ground and dispersed by irradiation with ultrasonic wave. The ethanol dispersion solution was centrifuged so as to separate the carbon nanotubes from the other components. A supernatant after processing was collected. The supernatant was dried, whereby a purified material containing carbon nanotubes was obtained. Due to the purification processing, the proportion of the carbon nanotubes in the material containing carbon nanotubes increased to 40 to 60% by volume.

The purified material containing carbon nanotubes was loaded into the cylinder of silver (diameter: 6 mm, thickness: 0.5 mm) to be the first member, and both ends of the cylinder were sealed with rubber plugs. The cylinder of silver was subjected to drawing until its diameter became 0.5 mm.

In this stage, the diameter of the material containing carbon nanotubes was about 0.3 mm. The linear electron emission material thus formed was cut into a length of 1 mm to obtain an electron emission member. In the same way as in Example 1, the cut surface of the electron emission member was evaluated for electron emission characteristics.

As a result, in the same way as in Example 1, emission of electrons from the material containing carbon nanotubes was observed by application of a voltage. Since the material containing carbon nanotubes was loaded into the hole of the cylindrical member made of silver, an emission electron flow traveled substantially in a straight line to allow a micro-point of the phosphor film 135 to emit light. In the above-mentioned evaluation, under the condition that a distance between the end facet of the electron emission member 14 and the anode electrode 134 was set at 1 mm, and a voltage of 2 kV was applied between the electron emission member 14 and the anode electrode 134, a field emission current of 1 mA or more flowed. Thus, it was confirmed that electrons were emitted more efficiently in Example 2 than in Example 1.

In Example 2, a high electron emission element with a high electron emission ability was obtained by using the purified material containing carbon nanotubes for the second member. Furthermore, even in the case where a carbon material, fullerene powders, or aluminum powders were added to the purified material containing carbon nanotubes to set the content of carbon nanotubes in a range of 1 to 50% by volume, the same results were obtained.

Furthermore, even when other additives that will not modify carbon nanotubes were used, the same results were obtained. More specifically, even when carbon materials such as graphite, fullerene, diamond-like carbon, and diamond; carbides of materials such as tungsten, molybdenum, chromium, tantalum, niobium, vanadium, zirconium, titanium, nickel, boron, nitrogen, and silicon; or mixtures thereof are used as additives, the same results were obtained.

In Example 2, the case has been described in which the cylinder member to be the first member is made of only silver. However, it was confirmed that metal which does not form a carbide, such as gold, copper, platinum, and aluminum, or mixtures thereof may be used.

Example 3

Example 3 is the case where the electron emission member **14*f* was produced by using the electron emission member 14** produced in Example 2.

First, one end facet of the electron emission member 14 produced in Example 2 was soaked in an acidic aqueous solution of nitric acid, sulfuric acid, or the like. Thus, a part of silver which is the first member was removed to form a convex portion (height: about 0.3 mm) made of a material containing carbon nanotubes. Thus, the electron emission member **14*f*** was produced, and the end facet having the convex portion was evaluated for electron emission characteristics in the same way as in: Example 1.

As a result, in the same way as in Example 1, emission of electrons from the material containing carbon nanotubes was observed by application of a voltage. In the above evaluation, under the condition that a distance between the end facet of the convex portion of the electron emission member **14*f* and the anode electrode 134 was set at 1 mm, and a voltage of 1 kV was applied between the electron emission member 14*f* and the anode electrode 134**, an field emission current of 1 mA or more flowed. Thus, it was confirmed that electrons were emitted more efficiently in Example 3 than in Example 1 or 2.

In Example 3, metal (first member) covering the second member was removed with an acidic aqueous solution. However, even in the case where the first member was removed mechanically or by other methods, the same results were obtained.

Example 4

Example 4 is the case where the electron emission element 10 shown in FIG. 1 was produced by using the electron emission member 14 produced in Example 2.

First, a cathode electrode, an insulating layer, and a control electrode were formed on a glass substrate, and the electron emission member 14 produced in Example 2 was placed on the cathode electrode. Furthermore, an anode electrode on which a phosphor film was formed was disposed so as to be opposed to the glass substrate, whereby the electron emission element 10 was produced. More specifically, in Example 4, a light-emitting device was formed.

In the above-mentioned electron emission element, electrons were extracted from a sample by application of a positive voltage to the control electrode. The extracted electrons were radiated to the phosphor film by an accelerated voltage applied to the anode electrode. Electron emission element characteristics were evaluated based on light, emission from the phosphor film caused by irradiation with electrons.

In the electron emission element, it was possible to change the amount of electrons emitted from the material containing carbon nanotubes (second member) by varying a voltage applied to the control electrode, which made it possible to control light emission of the phosphor film.

In Example 4, the case has been described, in which the material containing carbon nanotubes (second member) does not project from the cylindrical metal (first member). Even in the case where the material containing carbon nanotubes projects from the cylindrical metal (electron emission member 14*f*, etc.), the electron emission element functioned in the same way.

Example 5

Example 5 is the case where an electron emission source was produced by using the electron emission element produced in Example 4.

In the same way as in Example 4, a plurality of electron emission elements produced in Example 2 were placed on a glass substrate, and a positive voltage was applied to the control electrode of each electron emission element, respectively.

As a result, by changing a voltage applied to each control electrode, it as able to control an electron emission amount of the corresponding electron emission element.

Furthermore, in the case where the anode electrode was coated with a fluorescent substance, and the fluorescent substance was allowed to emit light by electrons emitted from each electron emission element, it was possible to two-dimensionally control light emission of the fluorescent substance by controlling a voltage applied to the control electrode. More specifically, it was confirmed that by applying an image signal to the control electrode, an electron emission source using the electron emission element of the present invention can be used as that of an image output device.

Example 6

Example 6 is the case where the electron emission member 14 was produced in which a second member contained fibrous graphite.

First, fibrous graphite powders were prepared as a material for the second member. The fibrous graphite can be produced, for example, by the same method (in this case, the pressure of He is decreased and/or discharge current is decreased during DC arc discharge) as that of the carbon nanotubes in Example 1. The fibrous graphite powders were loaded into a cylinder of silver (diameter: 6 mm, thickness: 0.5 mm) to be a first member, and both ends of the cylinder were sealed with rubber plugs. The cylinder of silver filled with fibrous graphite powders was subjected to drawing until it had a diameter of 0.5 mm. In this stage, a diameter of the second member containing fibrous graphite was about 0.3 mm. The linear electron emission material thus formed was cut to a length of 1 mm to obtain an electron emission member. In the same way as in Example 1, the cut surface of the electron emission member 14 was evaluated for electron emission characteristics.

When a voltage was applied between the cathode electrode and the anode electrode in the same way as in the above example, electron emission from the electron emission member (fibrous graphite was observed. When a distance between the end facet of the electron emission member and the anode electrode was set at 1 mm, and a voltage of 4 kV was applied between the electron emission member and the anode electrode, a field emission current of about 1 mA flowed.

In Example 6, the case has been described in which the second member contained fibrous graphite. However, even in the case where other materials such as carbon fiber, powdery metal with a low work function, an oxide with a low work function, and boron nitride were used as the second member, the same results were obtained.

Example 7

Example 7 is the case where the electron emission element 10*a* shown in FIG. 7 was produced by using the electron emission member produced in Example 2.

First, an insulating layer (thickness: about 5 to about 10$\mu$m) made of $SiO_2$ was formed on an outer periphery of the first member of the electron emission member produced in Example 2. Then, a conductive layer (aluminum layer) to be the control electrode was formed on the insulating layer. The insulating layer made of $SiO_2$ was formed by chemical vapor deposition or sputtering. Furthermore, the conductive layer made of aluminum was formed by vacuum evaporation. The electron emission member was placed on a cathode electrode formed on a glass substrate. Then, an anode electrode coated with a fluorescent substance was placed so as to be opposed to the glass substrate. In the electron emission element thus formed, electrons were extracted from a sample by applying a positive voltage to the control electrode, and thereafter, the extracted electrons were radiated to the fluorescent substance by an accelerated voltage applied to the anode electrode. Electron emission characteristics were evaluated by observing a phosphor film that emits light by irradiation with electrons.

As a result, it was confirmed that by applying a positive voltage to a conductive layer on the surface of the electron emission member which functions as the control electrode, electrons are emitted from the material containing carbon nanotubes present at the center of the electron emission member. Furthermore, it was able to change an electron emission amount and to control light emission of the phosphor film by varying a voltage value of the control electrode.

As described above, the present invention has been described by way of illustrative embodiments. However, the present invention is not limited thereto. The present invention is applicable to other embodiments based on the technical idea thereof.

For example, the light-emitting device described in the above embodiments is an example. Light-emitting devices with other structures may be used as long as they use the electron emission element of the present invention. Furthermore, although the electron emission elements including control electrodes have been described in the embodiments, it also may be possible that the electron emission element does not include a control electrode.

As described above, according to the present invention, a highly stable electron emission element with a high electron emission ability can be obtained. Furthermore, an electron emission source with a high electron emission ability can be obtained by disposing a plurality of such electron emission elements on the same substrate.

Furthermore, according to the method for producing an electron emission element of the present invention, the electron emission element of the present invention easily can be produced.

Furthermore, according to the present invention, a highly reliable light-emitting device with a high light emission intensity can be obtained. Furthermore, by applying such a light-emitting device to an image output device, it is possible to obtain a highly reliable image output device with a high light emission intensity and a low power consumption.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for producing an electron emission element including a cathode electrode, an anode electrode disposed so as to be opposed to the cathode electrode, and an electron emission member disposed on the cathode electrode, the method comprising:

filling a substantially cylindrical body made of a first material with a second material different from the first material, followed by drawing the substantially cylindrical body to decrease a diameter thereof, and cutting the substantially cylindrical body with the diameter decreased, thereby forming an electron emission member including a first member with a through-hole and a second member that fills the through-hole and is more likely to emit electrons than the first member.

2. A method for producing an electron emission element according to claim 1, wherein the second material contains a carbon nanotube.

3. A method for producing an electron emission element according to claim 1, further comprising: removing an end portion of the first member to form a convex portion formed of the second member on the electron emission member after forming the electron emission member.

4. A method for producing an electron emission element according to claim 1, wherein the second material is arranged substantially in one direction by drawing the substantially cylindrical body.

5. A method for producing an electron emission element according to claim 4, wherein the second material contains a carbon nanotube.

* * * * *

UNITED STATES PATENT AND TRADEMARK OFFICE

CERTIFICATE OF CORRECTION

PATENT NO. : 6,692,327 B1
DATED : February 17, 2004
INVENTOR(S) : Deguchi et al.

It is certified that error appears in the above-identified patent and that said Letters Patent is hereby corrected as shown below:

Title page,
Item [54], Title, "METHOD FOR PRODUCING ELECTRON EMITTING ELEMENT" should read -- METHOD FOR PRODUCING CYLINDRICAL ELECTRON EMISSION ELEMENT COMPRISING TWO MATERIALS --

Signed and Sealed this

Fourth Day of January, 2005

JON W. DUDAS
*Director of the United States Patent and Trademark Office*